US006712445B2

(12) United States Patent
Yonekubo

(10) Patent No.: US 6,712,445 B2
(45) Date of Patent: Mar. 30, 2004

(54) LIQUID JETTING APPARATUS

(75) Inventor: Shuji Yonekubo, Nagano-Ken (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 10/272,307

(22) Filed: Oct. 17, 2002

(65) Prior Publication Data

US 2003/0081025 A1 May 1, 2003

(30) Foreign Application Priority Data

Oct. 19, 2001 (JP) ..... 2001-322618
Oct. 19, 2001 (JP) ..... 2001-322637

(51) Int. Cl.[7] ..... B41J 29/393; B41J 29/38; B41J 2/205

(52) U.S. Cl. ..... 347/19; 347/9; 347/10; 347/11; 347/15

(58) Field of Search ..... 347/9–11, 19, 347/15

(56) References Cited

U.S. PATENT DOCUMENTS 6,134,020 A * 10/2000 Masumoto et al. ..... 358/1.16
6,400,099 B1 * 6/2002 Walker ..... 315/291
6,419,337 B2 * 7/2002 Sayama ..... 347/11
6,431,673 B1 * 8/2002 Heim et al. ..... 347/9
2001/0022595 A1 * 9/2001 Takahashi et al. ..... 347/5
2003/0048316 A1 * 3/2003 Bruch et al. ..... 347/12

FOREIGN PATENT DOCUMENTS

EP 1 138 489 A1 10/2001

* cited by examiner

*Primary Examiner*—Stephen D. Meier
*Assistant Examiner*—Alfred E Dudding
(74) *Attorney, Agent, or Firm*—Sughrue Mion, PLLC

(57) ABSTRACT

A liquid jetting apparatus of the invention includes: a head member having a nozzle; a pressure-changing unit that can cause pressure of liquid in the nozzle to change in such a manner that the liquid is jetted from the nozzle; a jetting-mode setting unit that can set a selected jetting mode from a plurality of jetting modes; a driving-signal generator that can generate a common jetting-driving signal; a driving-pulse generator that can generate a full-jetting driving pulse, based on the selected jetting mode and the common jetting-driving signal; and a full-jetting main controller that can cause the pressure-changing unit to operate, based on the full-jetting driving pulse.

38 Claims, 10 Drawing Sheets

LIQUID JETTING APPARATUS

FIELD OF THE INVENTION

This invention relates to a liquid jetting apparatus having a head member capable of jetting drops of liquid from nozzles. In particular, this invention relates to a liquid jetting apparatus that can suitably control a full-jetting state, which is called "fully-covering".

BACKGROUND OF THE INVENTION

In a ink-jetting recording apparatus such as an ink-jetting printer or an ink-jetting plotter (a kind of liquid jetting apparatus), a recording head (head member) can move in a main scanning direction, and a recording paper (a kind of recording medium) can move in a sub-scanning direction perpendicular to the main scanning direction. While the recording head moves in the main scanning direction, a drop of ink can be jetted from a nozzle of the recording head onto the recording paper. Thus, an image including a character or the like can be recorded on the recording paper. For example, the drop of ink can be jetted by causing a pressure chamber communicating with the nozzle to expand and/or contract.

The pressure chamber may be caused to expand and/or contract, for example by utilizing deformation of a piezoelectric vibrating member. In such a recording head, the piezoelectric vibrating member can be deformed based on a supplied driving-pulse in order to change a volume of the pressure chamber. When the volume of the pressure chamber is changed, a pressure of the ink in the pressure chamber may be changed. Then, the drop of ink is jetted from the nozzle.

In such a recording apparatus, a driving signal consisting of a series of a plurality of driving-pulses is generated. On the other hand, printing data including level data (gradation data) can be transmitted to the recording head. Then, based on the transmitted printing data, only necessary one or more driving-pulses are selected from the driving signal and supplied to the piezoelectric vibrating member. Thus, a volume of the ink jetted from the nozzle may be changed based on the level data.

The above recording apparatus can be used for jetting a plurality of kinds of ink. In the case, it is preferable that a driving signal is generated for each of the plurality of kinds of ink. However, in order to avoid problems such as cost in forming a circuit for generating the respective driving signals, a common driving signal may be used for all the plurality of kinds of ink.

In the latter case, it is usual that a controlling state for "fully-covering (fully-painting)" wherein level data of the highest density are continuous is adjusted for a kind of ink difficult to achieve the "fully-covering", that is, a kind of ink having a low ink-expansion characteristic (for example, a black ink).

However, if the "fully-covering" control is adjusted for the kind of ink having a low ink-expansion characteristic, regarding a kind of ink having a high ink-expansion characteristic (for example, a color ink), an amount of ink more than necessary to achieve the "fully-covering" is jetted, which tends to generate some oozy ink, which may cause a deterioration of recording quality.

In order to avoid the above problem, the inventor studied to adopt a "DUTY limit". However, if the "DUTY limit" is adopted, the resolution and the level steps are also reduced, that is, it becomes difficult to maintain the high recording quality.

In addition, in the above recording head, in order to improve the recording speed or the like, a plurality of nozzles may be formed in the recording head. In the case, the characteristic of jetting an ink drop in each nozzle may be different from each other, because of a reason regarding manufacture of the recording head or the like.

In conventional recording heads, there is no attempt to precisely adjust the volume (weight) of an ink drop jetted from each nozzle for one pixel according to the same level datum. However, if the volume (weight) of an ink drop jetted from a nozzle for one pixel according to the same level datum is different from that from another nozzle, a problem about the recording quality may be generated in particular in a full-jetting (fully-covering) control.

The inventor studied to generate a driving signal for each nozzle in order to jet a proper volume (weight) of ink drop always. However, in the view of cost in forming a circuit for generating the driving signals or the like, the inventor judged that the concept is not practical at least for the present.

SUMMARY OF THE INVENTION

The object of this invention is to provide a liquid jetting apparatus such as a ink-jet recording apparatus that can suitably control a full-jetting state called "fully-covering", even if a common driving signal is used for respective kinds of liquid.

In order to achieve the object, the invention is a liquid jetting apparatus comprising: a head member having a nozzle; a pressure-changing unit that can cause pressure of liquid in the nozzle to change in such a manner that the liquid is jetted from the nozzle; a jetting-mode setting unit that can set a selected jetting mode from a plurality of jetting modes; a driving-signal generator that can generate a common jetting-driving signal; a driving-pulse generator that can generate a full-jetting driving pulse, based on the selected jetting mode and the common jetting-driving signal; and a full-jetting main controller that can cause the pressure-changing unit to operate, based on the full-jetting driving pulse.

According to the above feature, since the full-jetting driving pulse is generated based on the selected jetting mode and the common jetting-driving signal, even if the common jetting-driving signal is used for a plurality of kinds of liquid, the full-jetting state can be controlled suitably for each of the plurality of kinds of liquid.

Preferably, weights of the liquid jetted from the nozzle based on respective full-jetting driving pulses are different according to respective jetting modes. That is, by making actual weights of the jetted liquid different, a uniform "fully-covering" can be easily achieved even although the respective kinds of liquid have respective liquid-expansion characteristics.

Preferably, the common jetting-driving signal is a periodical signal including a plurality of (separated) the same pulse-waves within a period thereof, and the driving-pulse generator is adapted to generate a rectangular-pulse row corresponding to the period of the common jetting-driving signal based on the selected jetting mode, and generate an AND signal of the rectangular-pulse row and the common jetting-driving signal as the full-jetting driving pulse.

If the above manner is adopted, a process of generating the full-jetting driving pulse can be easily materialized.

In a concrete example, if the plurality of jetting modes include a first jetting mode and a second jetting mode, and the common jetting-driving signal is a periodical signal including n the same pulse-waves within a period thereof, the driving-pulse generator can generate a full-jetting driving-pulse including only p pulse-waves when the selected jetting mode is the first jetting mode, p being one or more, and another full-jetting driving-pulse including only q pulse-waves when the selected jetting mode is the second jetting mode, q being more than p and not more than n, based on the common jetting-driving signal.

In the case, for example, a weight of the liquid jetted from the nozzle based on the one pulse-wave is 7 ng.

In addition, for example, n=7, p=5 or 6, and q=7.

In addition, preferably, the jetting-mode setting unit has: an input part into which desired dense-thin information is inputted by a user, and a jetting-mode setting main part that is adapted to set a selected jetting mode based on the desired dense-thin information inputted into the input part. In the case, a "fully-covering" control based on dense-thin desire of the user can be achieved.

In detail, for example, the jetting-mode setting main part can change at least one of p and q, based on the desired dense-thin information inputted into the input part.

In addition, it is preferable that the jetting-mode setting unit sets as a selected jetting mode the first jetting mode when the liquid has a high liquid-expansion characteristic, and the second jetting mode when the liquid has a low liquid-expansion characteristic.

The reason is that when the liquid has a high liquid-expansion characteristic, a sufficient "fully-covering" control can be achieved by a smaller amount of the jetted liquid, while when the liquid has a low liquid-expansion characteristic, a sufficient "fully-covering" control needs a larger amount of the jetted liquid.

In addition, preferably, the jetting-mode setting unit has: an information reader that can obtain liquid information regarding the liquid included in a liquid cartridge from the liquid cartridge, the liquid cartridge being mounted on the head member; and a jetting-mode setting main part that is adapted to set a selected jetting mode based on the liquid information obtained by the information reader.

In the case, since the liquid information regarding the liquid included in the liquid cartridge can be obtained by the information reader, a "fully-covering" control can be achieved suitably for each of the plurality of kinds of liquid.

In addition, preferably, the jetting-mode setting unit sets as a selected jetting mode the first jetting mode when a medium onto which the liquid is jetted has a high liquid-expansion characteristic, and the second jetting mode when the medium onto which the liquid is jetted has a low liquid-expansion characteristic.

In addition, the invention is a controlling unit that can control a liquid jetting apparatus including a head member having a nozzle, and a pressure-changing unit that can cause pressure of liquid in the nozzle to change in such a manner that the liquid is jetted from the nozzle; the controlling unit comprising: a jetting-mode setting unit that can set a selected jetting mode from a plurality of jetting modes; a driving-signal generator that can generate a common jetting-driving signal; a driving-pulse generator that can generate a full-jetting driving pulse, based on the selected jetting mode and the common jetting-driving signal; and a full-jetting main controller that can cause the pressure-changing unit to operate, based on the full-jetting driving pulse.

In addition, the object of this invention is to provide a liquid jetting apparatus such as a ink-jet recording apparatus that can suitably control a full-jetting state called "fully-covering", even if a characteristic of jetting a liquid drop in a nozzle is different from that in another nozzle, because of a reason regarding manufacture of a head member or the like.

In order to achieve the object, the invention is a liquid jetting apparatus comprising: a head member having a plurality of nozzles; a plurality of pressure-changing units each of which can cause pressure of liquid in each of the plurality of nozzles to change in such a manner that the liquid is jetted from the nozzle; a driving-signal generator that can generate a common jetting-driving signal; a mode storing unit that can store a jetting-amount-adjusting mode that has been set for each of the plurality of nozzles; a driving-pulse generator that can generate a full-jetting driving pulse for each of the plurality of nozzles, based on the jetting-amount-adjusting mode and the common jetting-driving signal; and a full-jetting main controller that can cause each of the plurality of pressure-changing units to operate, based on the full-jetting driving pulse.

If the plurality of nozzles forms a plurality of nozzle rows, the characteristics of jetting a liquid drop in the nozzles forming the same nozzle row tend to be the same, because of a reason regarding manufacture of a head member or the like. Thus, in order to achieve a control for jetting a liquid drop more simply, it is preferable to adopt a control manner not for each nozzle but for each nozzle row.

That is, the invention is a liquid jetting apparatus comprising: a head member having a plurality of nozzles forming a plurality of nozzle rows; a plurality of pressure-changing units each of which can cause pressure of liquid in each of the plurality of nozzles to change in such a manner that the liquid is jetted from the nozzle; a driving-signal generator that can generate a common jetting-driving signal; a mode storing unit that can store a jetting-amount-adjusting mode that has been set for each of the plurality of nozzle rows; a driving-pulse generator that can generate a full-jetting driving pulse for each of the plurality of nozzle rows, based on the jetting-amount-adjusting mode and the common jetting-driving signal; and a full-jetting main controller that can cause each of the plurality of pressure-changing units to operate, based on the full-jetting driving pulse.

According to the above respective features, since the full-jetting driving pulse is generated based on the jetting-amount-adjusting mode and the common jetting-driving signal, the full-jetting state can be suitably controlled, even if a characteristic of jetting a liquid drop in a nozzle is different from that in another nozzle, or even if a characteristic of jetting a liquid drop in a nozzle row is different from that in another nozzle row.

Preferably, the common jetting-driving signal is a periodical signal including a plurality of the same pulse-waves within a period thereof, and the driving-pulse generator is adapted to generate a rectangular-pulse row corresponding to the period of the common jetting-driving signal based on the jetting-amount-adjusting mode, and generate an AND signal of the rectangular-pulse row and the common jetting-driving signal as the full-jetting driving pulse.

If the above manner is adopted, a process of generating the full-jetting driving pulse can be easily materialized.

In a concrete example, if the jetting-amount-adjusting mode may be a first adjusting mode for a nozzle from which a larger amount of the liquid tends to be jetted or a second adjusting mode for a nozzle from which a smaller amount of the liquid tends to be jetted, the common jetting-driving signal is a periodical signal including n the same pulse-waves within a period thereof, and the driving-pulse generator can generate a full-jetting driving-pulse including only p pulse-waves when the jetting-amount-adjusting mode is the first adjusting mode, p being one or more, and another full-jetting driving-pulse including only q pulse-waves when the jetting-amount-adjusting mode is the second adjusting mode, q being more than p and not more than n, based on the common jetting-driving signal.

Alternatively, if the jetting-amount-adjusting mode may be a first adjusting mode for a nozzle from which a larger amount of the liquid tends to be jetted or a second adjusting mode for a nozzle from which an intermediate amount of the liquid tends to be jetted or a third adjusting mode for a nozzle from which a smaller amount of the liquid tends to be jetted, the common jetting-driving signal is a periodical signal including n the same pulse-waves within a period thereof, and the driving-pulse generator can generate a full-jetting driving-pulse including only p pulse-waves when the jetting-amount-adjusting mode is the first adjusting mode, p being one or more, another full-jetting driving-pulse including only q pulse-waves when the jetting-amount-adjusting mode is the second adjusting mode, q being more than p, and another full-jetting driving-pulse including only r pulse-waves when the jetting-amount-adjusting mode is the third adjusting mode, r being more than q and not more than n, based on the common jetting-driving signal.

In the above cases, for example, a weight of the liquid jetted from the nozzle based on the one pulse-wave is 3 to 5 ng.

In addition, the invention is a controlling unit that can control a liquid jetting apparatus including a head member having a plurality of nozzles, and a plurality of pressure-changing units each of which can cause pressure of liquid in each of the plurality of nozzles to change in such a manner that the liquid is jetted from the nozzle; the controlling unit comprising: a driving-signal generator that can generate a common jetting-driving signal; a mode storing unit that can store a jetting-amount-adjusting mode that has been set for each of the plurality of nozzles; a driving-pulse generator that can generate a full-jetting driving pulse for each of the plurality of nozzles, based on the jetting-amount-adjusting mode and the common jetting-driving signal; and a full-jetting main controller that can cause each of the plurality of pressure-changing units to operate, based on the full-jetting driving pulse.

In addition, the invention is a controlling unit that can control a liquid jetting apparatus including a head member having a plurality of nozzles forming a plurality of nozzle rows, and a plurality of pressure-changing units each of which can cause pressure of liquid in each of the plurality of nozzles to change in such a manner that the liquid is jetted from the nozzle; the controlling unit comprising: a driving-signal generator that can generate a common jetting-driving signal; a mode storing unit that can store a jetting-amount-adjusting mode that has been set for each of the plurality of nozzle rows; a driving-pulse generator that can generate a full-jetting driving pulse for each of the plurality of nozzle rows, based on the jetting-amount-adjusting mode and the common jetting-driving signal; and a full-jetting main controller that can cause each of the plurality of pressure-changing units to operate, based on the full-jetting driving pulse.

For example, the pressure-changing unit may have a piezoelectric vibrating member.

For example, the liquid is a kind of ink.

A computer system can materialize the controlling unit or any element of the above controlling unit.

This invention includes a storage unit capable of being read by a computer, storing a program for materializing the controlling unit or the element in a computer system.

This invention also includes the program itself for materializing the controlling unit or the element in the computer system.

This invention includes a storage unit capable of being read by a computer, storing a program including a command for controlling a second program executed by a computer system including a computer, the program being executed by the computer system to control the second program to materialize the controlling unit or the element.

This invention also includes the program itself including the command for controlling the second program executed by the computer system including the computer, the program being executed by the computer system to control the second program to materialize the controlling unit.

The storage unit may be not only a substantial object such as a floppy disk or the like, but also a network for transmitting various signals.

BEST MODE FOR CARRYING OUT THE INVENTION

Embodiments of the invention will now be described in more detail with reference to drawings.

First Embodiment

Figure 1:
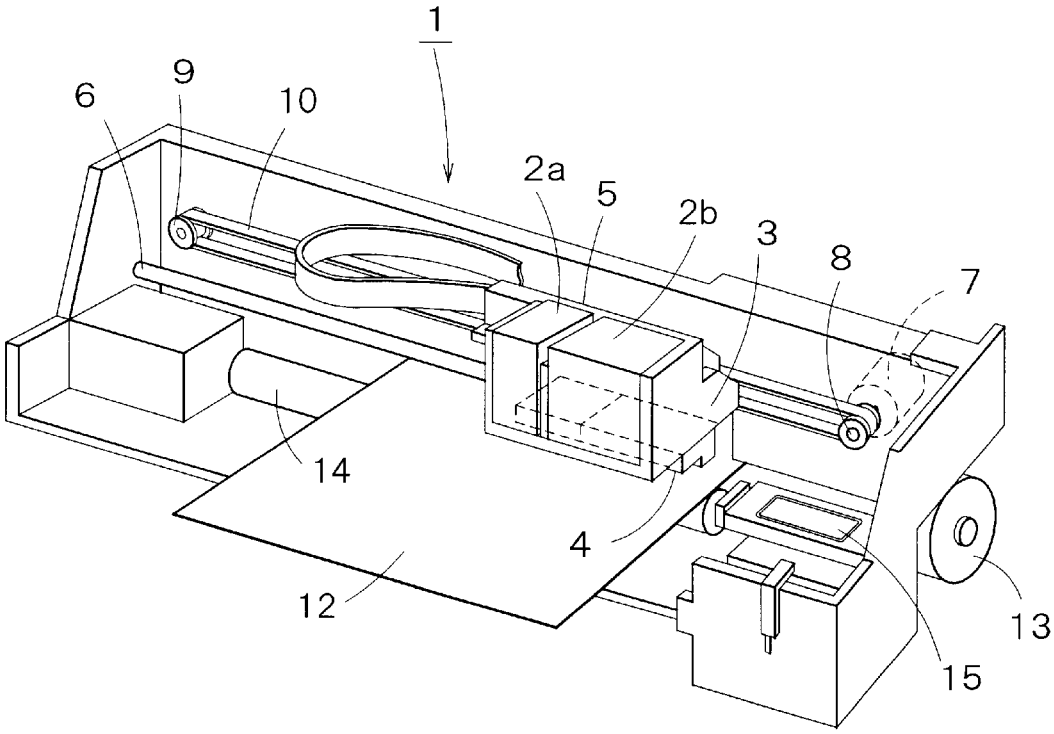
FIG. 1 is a schematic perspective view of an ink-jetting recording apparatus of an embodiment according to the invention.

FIG. 1 is a schematic perspective view of an ink-jetting printer 1 as a liquid jetting apparatus of a first embodiment according to the invention. The ink-jetting printer 1 includes a carriage 5, which has a recording head 4 (head member) and a cartridge holder 3 capable of holding a black-ink cartridge 2*a* and a color-ink cartridge 2*b*. The carriage 5 is adapted to be reciprocated in a main scanning direction by a head-scanning mechanism.

The head-scanning mechanism is formed by: a guide bar 6 horizontally extending in a housing, a pulse motor 7 arranged at a right portion of the housing, a driving pulley 8 connected to a rotational shaft of the pulse motor 7, a free pulley 9 mounted at a left portion of the housing, a timing belt 10 connected to the carriage 5 and going around the driving pulley 8 and the free pulley 9, and a controller 11 (see FIG. 6) for controlling the pulse motor 7. Thus, the carriage 5 i.e. the recording head 4 can be reciprocated in the main scanning direction i.e. in a width direction of a recording paper 12, by driving the pulse motor 7.

The printer 1 includes a paper feeding mechanism for feeding the recording paper 12 or any other recording medium (a medium onto which the ink is jetted) in a feeding direction (sub-scanning direction). The paper feeding mechanism consists of a paper feeding motor 13, a paper feeding roller 14 or the like. The recording paper 12, which is an example of a recording medium, is fed in a subordinate scanning direction in turn by the paper feeding mechanism, in cooperation with the recording operation of the recording head 4.

The head scanning mechanism and the paper feeding mechanism in the embodiment are adapted to handle a recording paper 12 having a larger size such as a B-0 size. In addition, the printer 1 is adapted to conduct a recording operation when the recording head 4 is moved forth (single-direction recording).

Figure 2A:
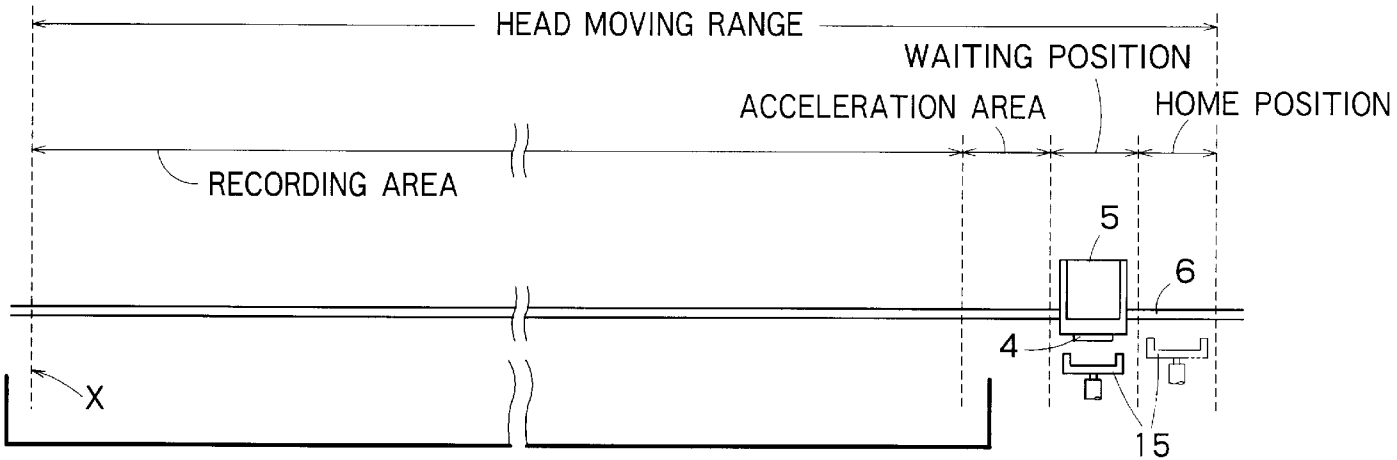
FIG. 2A is a schematic view for explaining a scanning range of a recording head when the ink-recording apparatus conducts a single-direction (one-way) printing.

A home position and a waiting position of the recording head 4 (carriage 5) are set in a scanning range of the carriage 5 and in an end area outside an objective recording area. As shown in FIG. 2A, the home position is set at an end portion (a right end portion in FIG. 2A) in the scanning range of the recording head 4. The waiting position is set substantially adjacently to the home position on a side of the objective recording area.

This invention can be applied to a printer that is adapted to conduct a recording operation when the recording head 4 is moved back as well when the recording head 4 is moved forth (double-direction recording). In such a printer, as shown in FIG. 2B, a second waiting position WP2 may be set at an opposite end portion with respect to a home position, in addition to a first waiting position WP1 substantially adjacent to the home position.

Figure 3A:
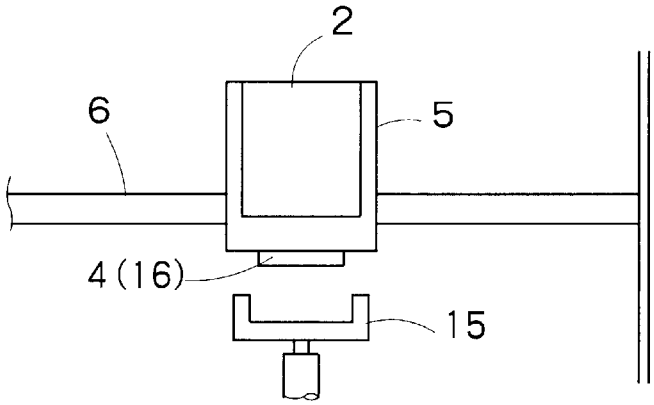
FIG. 3A is a schematic view for explaining a movement of the recording head, the recording head being located at a waiting position.
Figure 3B:
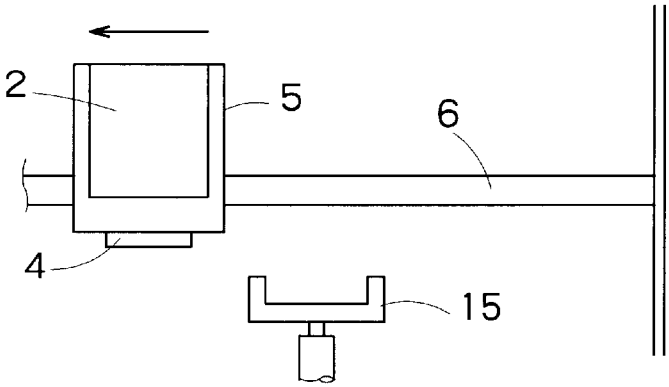
FIG. 3B is a schematic view for explaining the movement of the recording head, the recording head being moved from the waiting position to an objective recording area.
Figure 3C:
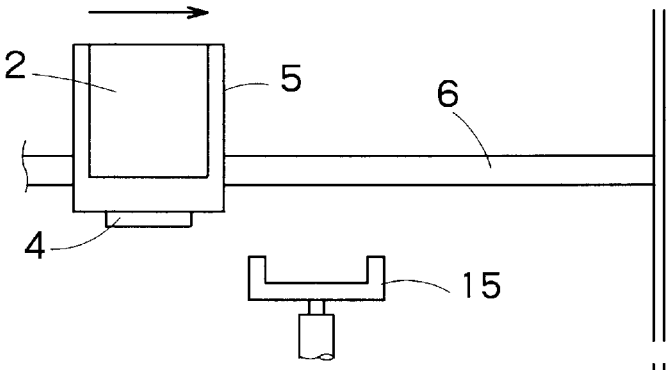
FIG. 3C is a schematic view for explaining the movement of the recording head, the recording head being moved back from the objective recording area to the waiting position.
Figure 3D:
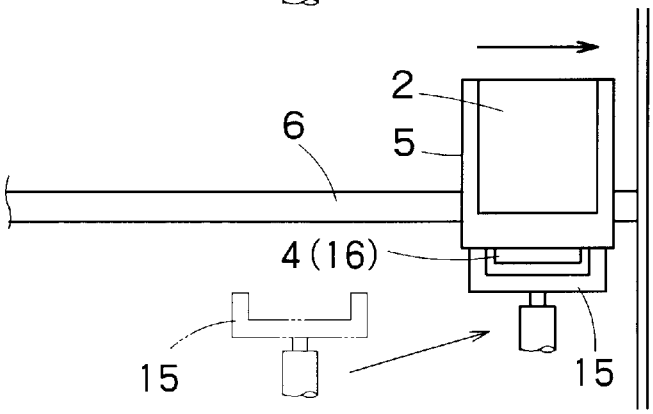
FIG. 3D is a schematic view for explaining the movement of the recording head, the recording head being located at a home position.

The home position is a position that the recording head 4 is moved to and stays at when electric power supply is off or when a long time has passed since the last recording operation. When the recording head 4 stays at the home position, as shown in FIG. 3D, a capping member 15 of the capping mechanism comes in contact with a nozzle plate 16 (see FIG. 4) and seals nozzles 17 (see FIG. 4). The capping member 15 is a tray-like member having a substantially square shape, being open upward, and made of an elastic material such as a rubber. A moisture retaining material such as felt is attached inside the capping member 15. When the recording head 4 is sealed by the capping member 15, an inside of the capping member 15 is kept in high humid condition. Thus, it can be prevented that solvent of the ink evaporates from the nozzles 17.

The waiting position is a starting position for moving the recording head 4 in the main scanning direction. That is, normally, the recording head 4 stays and waits at the waiting position. When a recording operation is started, the recording head 4 is moved from the waiting position to the objective recording area. Then, when the recording operation is completed, the recording head 4 is moved back to the waiting position.

Figure 2B:
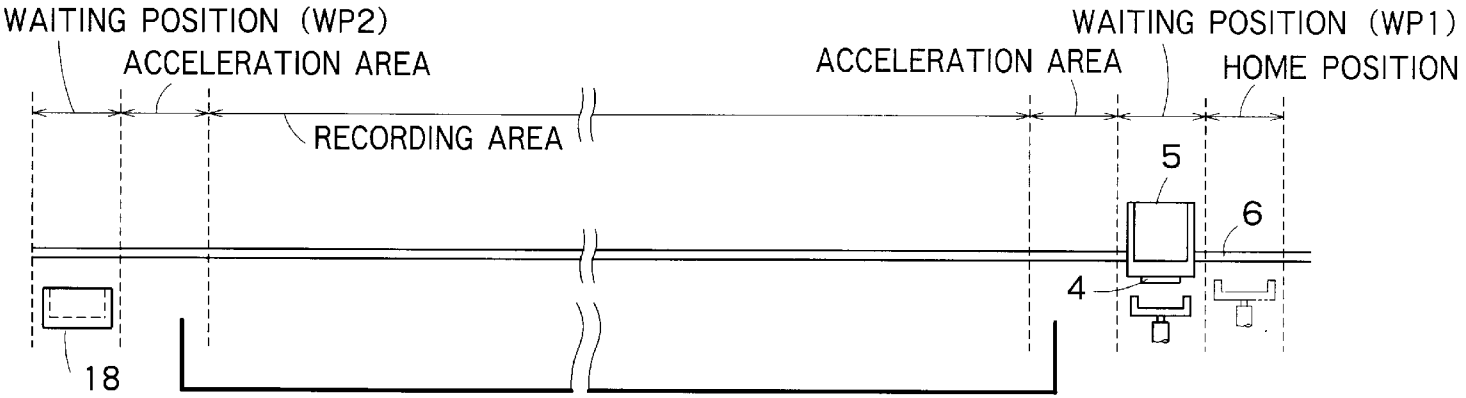
FIG. 2B is a schematic view for explaining a scanning range of a recording head when the ink-recording apparatus conducts a double-direction (forth and back) printing.

In a case of the printer for the double-direction recording, with reference to FIG. 2B, the recording head 4 is moved forth from the first waiting position WP1 to the second waiting position WP2 through the objective recording area, while jetting one or more drops of ink to the objective recording area. After that, the recording head 4 stays and waits at the second waiting position WP2. Then, the recording head 4 is moved back from the second waiting position WP2 to the first waiting position WP1 through the objective recording area, while jetting one or more drops of ink to the objective recording area. After that, the recording head 4 stays and waits at the first waiting position WP1. After that, the recording operation during moved forth and the recording operation during moved back are repeated in turn.

An ink-receiving member may be arranged under the waiting position in order to collect ink discharged from the recording head 4 because of flushing operations (maintenance operations). In the embodiment, the capping member 15 functions as such an ink-receiving member. That is, as shown in FIG. 3A, the capping member 15 is usually located at a position under the waiting position of the recording head 4 (a little apart from the nozzle plate 16). Then, when the recording head 4 is moved to the home position, as shown in FIG. 3D, the capping member 15 is also moved diagonally upward to the home position and to the nozzle plate 16 in order to seal the nozzles 17.

In the case of the printer for the double-direction recording, as shown in FIG. 2B, a second ink-receiving member 18 may be arranged under the second waiting position WP2. The second ink-receiving member 18 may be a flushing box open upward i.e. toward the recording head 4.

In addition, in the embodiment, an acceleration area is set between the waiting position and the objective recording area. The acceleration area is an area for raising a scanning velocity of the recording head 4 to a predetermined velocity.

Figure 4:
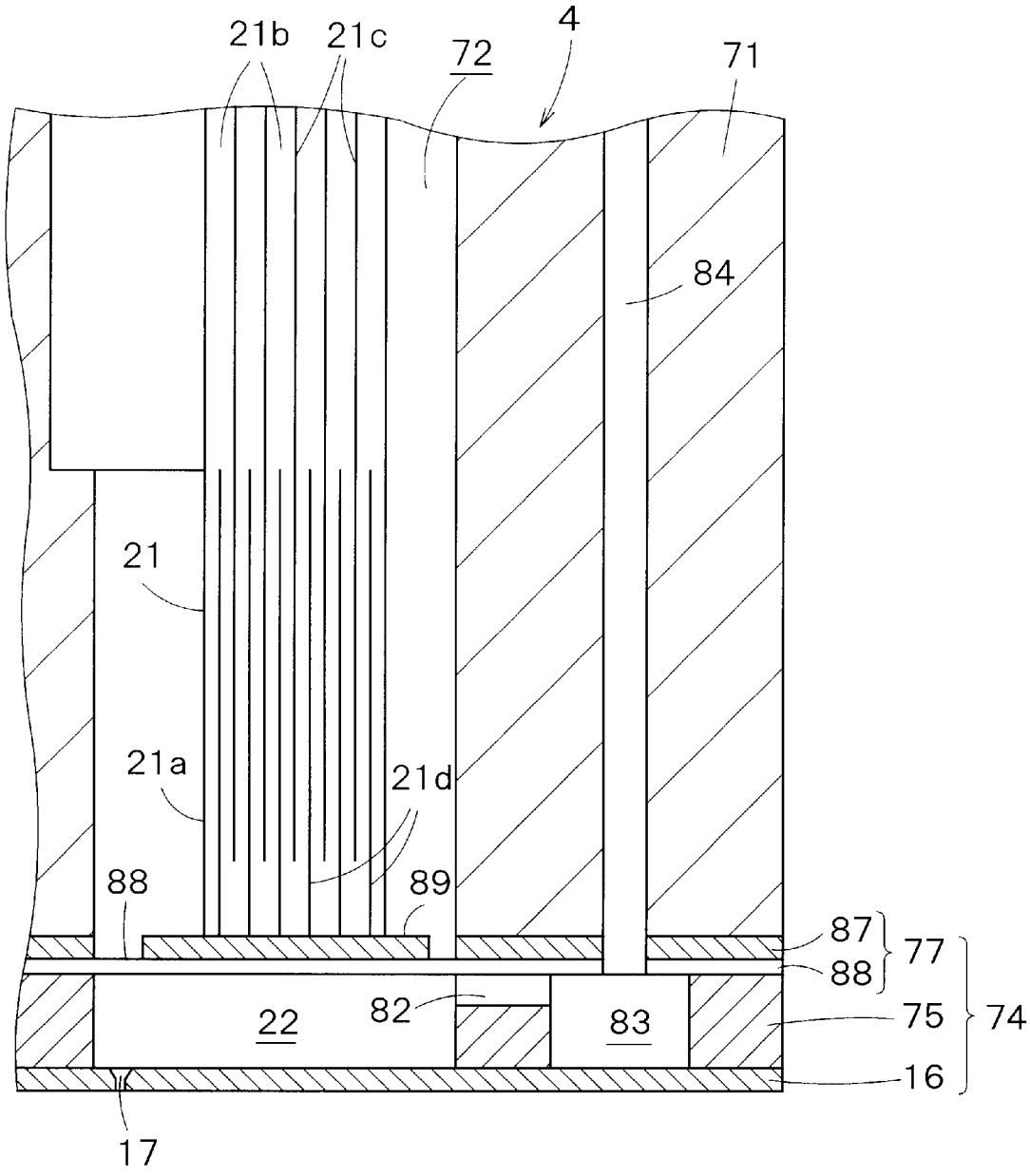
FIG. 4 is a sectional view of an example of a recording head.

Then, the recording head 4 is explained. As shown in FIG. 4, the recording head 4 has a plastic box-like case 71 defining a housing room 72. The longitudinal-mode piezoelectric vibrating unit 21 has a shape of teeth of a comb, and is inserted in the housing room 72 in such a manner that points of teeth-like portions 21*a* of the piezoelectric vibrating unit 21 are aligned at an opening of the housing room 72. A ink-way unit 74 is bonded on a surface of the case 71 on the side of the opening of the housing room 72. The points of the teeth-like portions 21*a* are fixed at predetermined positions of the ink-way unit 74 to function as piezoelectric vibrating members respectively.

The piezoelectric vibrating unit 21 comprises a plurality of piezoelectric layers 21*b*. As shown in FIG. 4, common inside electrodes 21*c* and individual inside electrodes 21*d* are inserted alternately between each adjacent two of the piezoelectric layers 21*b*. The piezoelectric layers 21*b*, the common inside electrodes 21*c* and the individual inside electrodes 21*d* are integrated and cut into the shape of the teeth of the comb. Thus, when a voltage is provided between the common inside electrodes 21*c* and an individual inside electrode 21*d*, a piezoelectric vibrating member contracts in a longitudinal direction of each of the piezoelectric layers 21*b*.

The ink-way unit 74 consists of a nozzle plate 16, an elastic plate 77 and an ink-way forming plate 75 sandwiched between the nozzle plate 16 and the elastic plate 77. The nozzle plate 16, the ink-way forming plate 75 and the elastic plate 77 are integrated as shown in FIG. 4.

A plurality of nozzles 17 is formed in the nozzle plate 16. A plurality of pressure generating chambers 22, a plurality of ink-supplying ways 82 and a common ink-chamber 83 are formed in the ink-way forming plate 75. Each of the pressure chambers 22 is defined by partition walls, and is communicated with a corresponding nozzle 17 at an end portion thereof and with a corresponding ink-supplying way 82 at the other end portion thereof. The common ink-chamber 83 is communicated with all the ink-supplying ways 82, and has a longitudinal shape. For example, the longitudinal common ink-chamber 83 may be formed by an etching process when the ink-way forming plate 75 is a silicon wafer. Then, the pressure chambers 22 are formed in the longitudinal direction of the common ink-chamber 83 at the same intervals (pitches) as nozzles 17. Then, a groove as an ink-supplying way 82 is formed between each of the pressure chambers 22 and the common ink-chamber 83. In the case, the ink-supplying way 82 is connected to an end of the pressure chamber 22, while the nozzle 17 is located near the other end of the pressure chamber 22. The common ink-chamber 83 is adapted to supply ink saved in an ink cartridge to the pressure chambers 22. An ink-supplying tube 84 from the ink cartridge is communicated with a middle portion of the common ink-chamber 83.

The elastic plate 77 is layered on a surface of the ink-way forming plate 75 opposed to the nozzle plate 16. In the case, the elastic plate 77 consists of two laminated layers that are a stainless plate 87 and an elastic high-polymer film 88 such as a PPS film. The stainless plate 87 is provided with island portions 89 for fixing the teeth-like portions 21*a* as the piezoelectric vibrating members 21 in respective portions corresponding to the pressure chambers 22, by an etching process.

In the above recording head 4, a tooth-like portion 21*a* as a piezoelectric vibrating member can expand in the longitudinal direction. Then, an island portion 89 is pressed toward the nozzle plate 16, the elastic film 88 is deformed. Thus, a corresponding pressure chamber 22 contracts. On the other hand, the tooth-like portion 21*a* as the piezoelectric vibrating member can contract from the expanding state in the longitudinal direction. Then, the elastic film 88 is returned to the original state owing to elasticity thereof. Thus, the corresponding pressure chamber 22 expands. By causing the pressure chamber 22 to expand and then causing the pressure chamber 22 to contract, a pressure of the ink in the pressure chamber 22 increases so that the ink drop is jetted from a nozzle 17.

That is, in the above recording head 4, when a tooth-like portion 21*a* as a piezoelectric vibrating member is charged or discharged, the volume of the corresponding pressure chamber 22 is also changed. Thus, by using the change of the volume of the pressure chamber 22, the pressure of the ink in the pressure chamber 22 can be changed, so that a drop of the ink can be jetted from the corresponding nozzle 17 or a meniscus at the corresponding nozzle 17 can be minutely vibrated. The meniscus means a free surface of the ink exposed at an opening of the nozzle 17.

Instead of the above longitudinal-mode piezoelectric vibrating unit 21, bending-mode piezoelectric vibrating members can be used. When a bending-mode piezoelectric vibrating member is used, a charging operation causes a pressure chamber to contract, and a discharging operation causes the pressure chamber to expand.

In the case, the recording head 4 is a many-color-recording head that is capable of recording with a different plurality of colors. Thus, the recording head 4 has a plurality of head units. Respective predetermined colors are set for and used in the plurality of head units, respectively.

Figure 5:
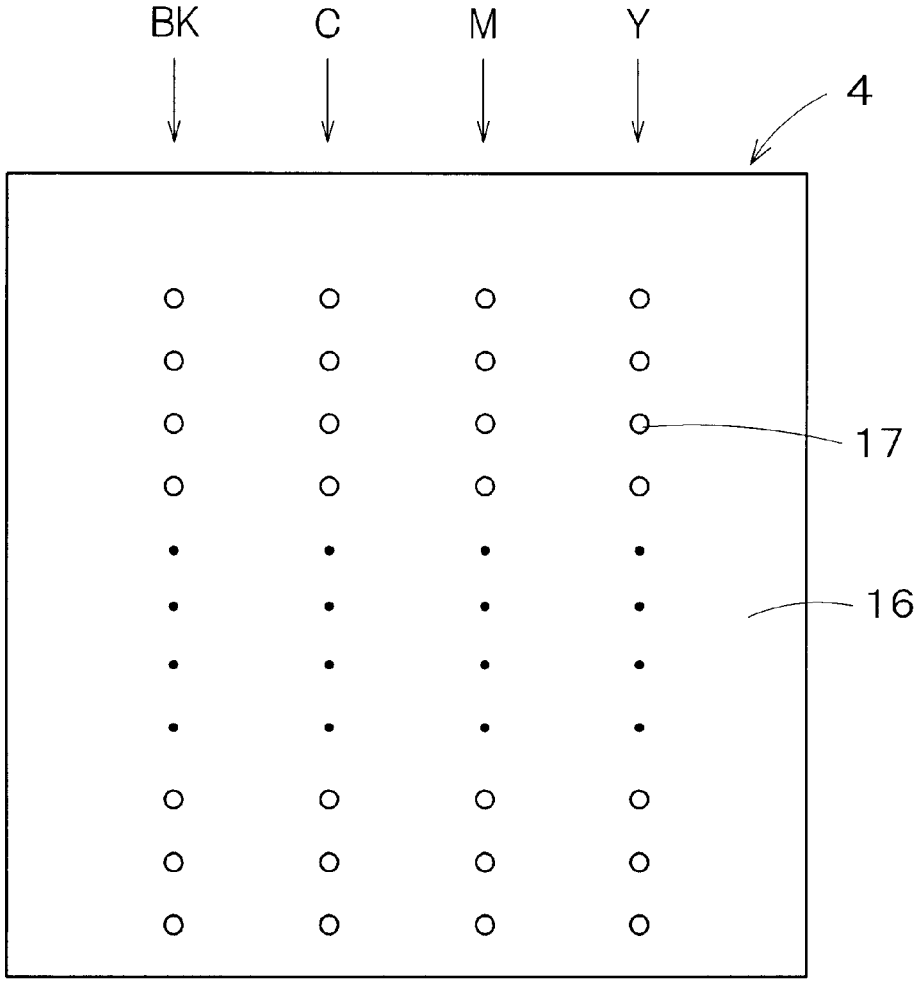
FIG. 5 is a plan view of a nozzle plate including four nozzle rows, each of which corresponds to each color.

In detail, the recording head 4 has: a black head unit capable of jetting a drop of black ink, a cyan head unit capable of jetting a drop of cyan ink, a magenta head unit capable of jetting a drop of magenta ink, and a yellow head unit capable of jetting a drop of yellow ink. The respective head units are communicated to respective ink chambers in the ink cartridges 2*a* and 2*b*. Each head unit has a structure as explained above with reference to FIG. 4. As shown in FIG. 5, four nozzle rows are formed by the nozzles 17, each nozzle row corresponding to each color (BK, C, M and Y).

Characteristics of jetting a drop of ink in the nozzles 17 forming the same nozzle row tend to be substantially the same, because of some reasons regarding manufacture of the recording head 4.

Figure 7:
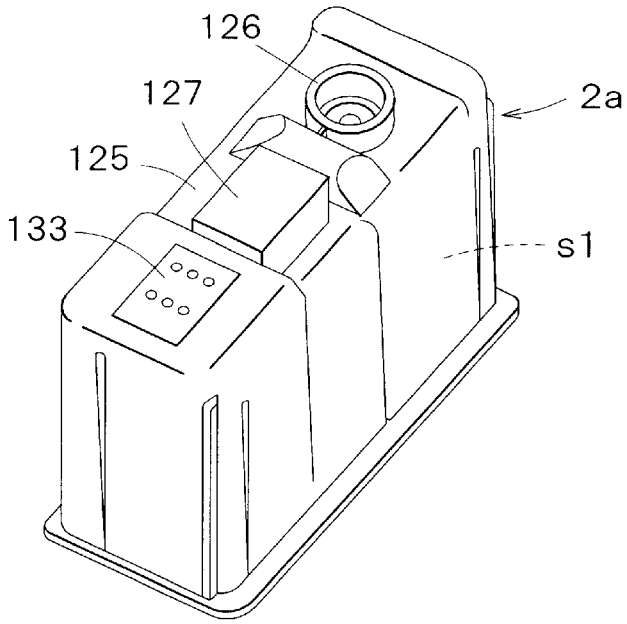
FIG. 7 is a schematic perspective view of an example of black-ink cartridge.
Figure 8:
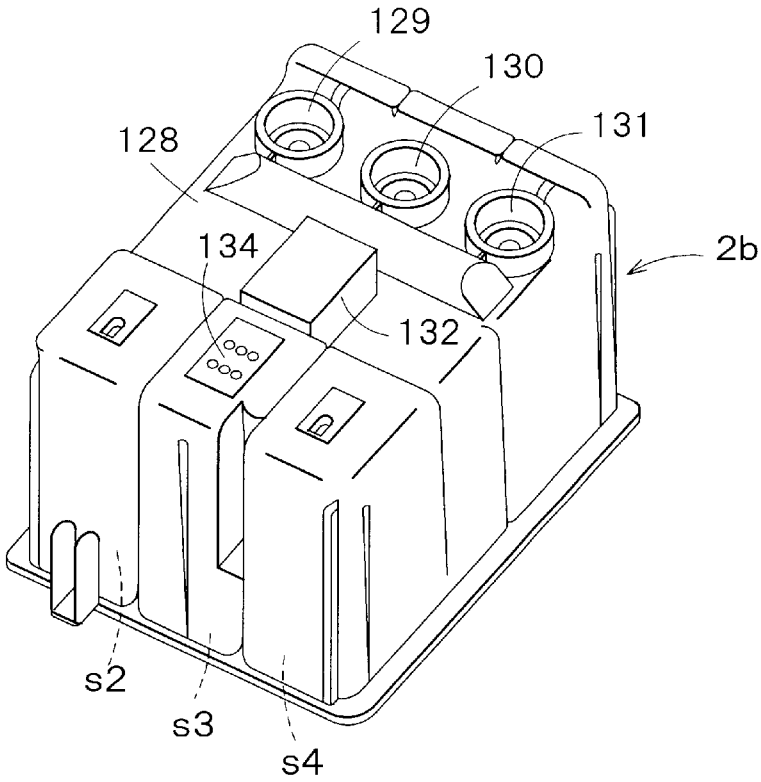
FIG. 8 is a schematic perspective view of an example of three-color-ink cartridge.
Figure 9:
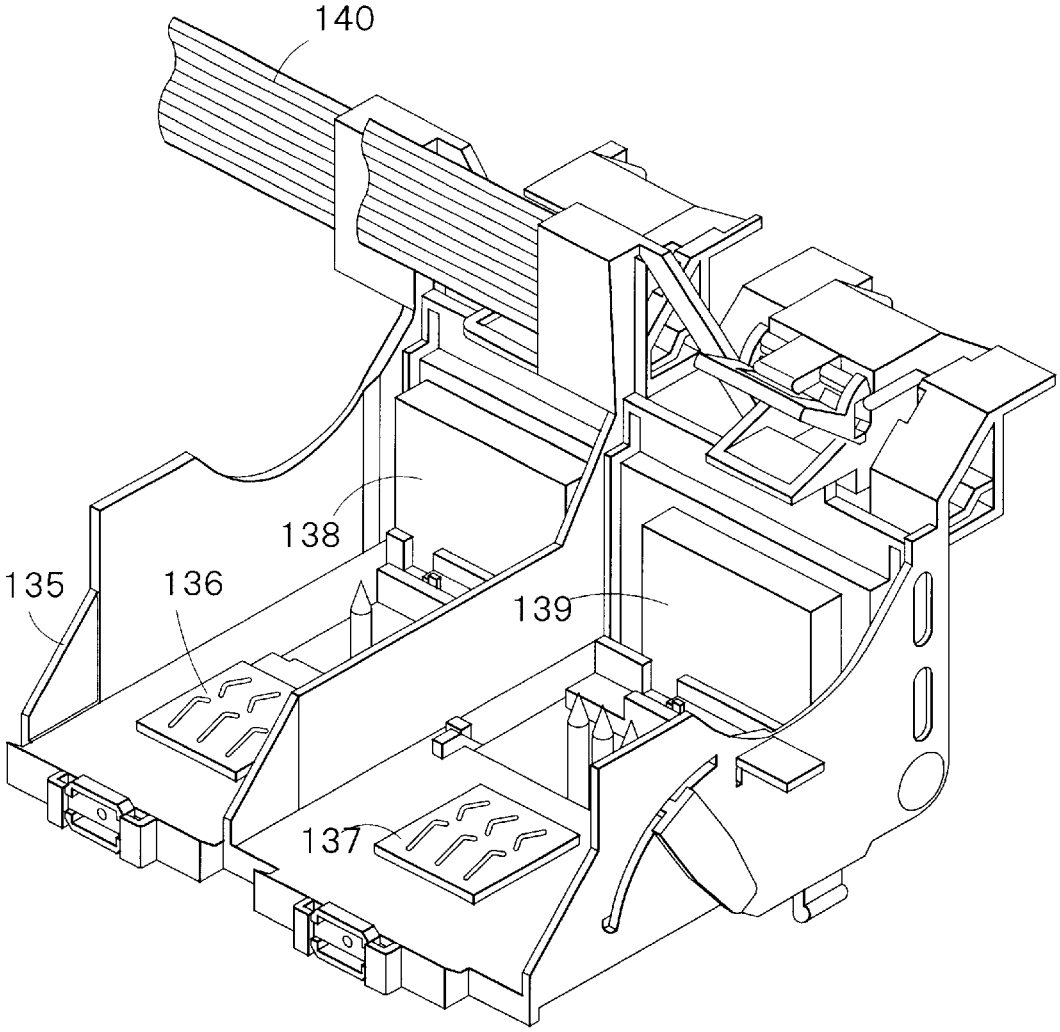
FIG. 9 is a schematic perspective view of an example of holder at which the ink cartridges are set.

Herein, with reference to FIGS. 7 to 9, the black-ink cartridge 2*a* and the color-ink cartridge 2*b* are explained in detail.

FIG. 7 is a schematic perspective view of the black-ink cartridge 2*a*. As shown in FIG. 7, the black-ink cartridge 2*a* has an ink chamber S1 that contains black ink. An ink supplying port 126, which can connect the ink chamber S1 and the black head unit of the recording head 4, is provided at a base portion 125 of the black-ink cartridge 2*a*. In addition, a semiconductor storing means 127 (storing part), which is a memory capable of rewriting data electrically, is provided on the base portion 125. Furthermore, an electrical terminal 133 for accessing the semiconductor storing means 127 is also provided on the base portion 125.

In the case, the semiconductor storing means 127 stores information about characteristics of the black ink contained in the ink chamber S1. The ink chamber S1 contains the black ink by containing a foam member filled with black pigment ink.

FIG. 8 is a schematic perspective view of the color-ink cartridge 2*b*. As shown in FIG. 8, the color-ink cartridge 2*b* has ink chambers S2, S3 and S4 that separately contain yellow ink, magenta ink and cyan ink, respectively. Ink supplying ports 129–131, which can connect the respective ink chambers S2, S3 and S4 and the respective color head units of the recording head 4, are provided at a base portion 128 of the color-ink cartridge 2*b*. In addition, a semiconductor storing means 132 (storing part), which is a memory capable of rewriting data electrically, is provided on the base portion 128. Furthermore, an electrical terminal 134 for accessing the semiconductor storing means 132 is also provided on the base portion 128.

In the case, the semiconductor storing means 132 stores information about characteristics of the respective inks contained in the respective ink chambers S2–S4. Each of the ink chambers S2–S4 contains the color ink by containing a foam member filled with color pigment ink.

FIG. 9 is a schematic perspective view of a head holder 135 at which the ink cartridges 2*a* and 2*b* shown in FIGS. 7 and 8 are set. As shown in FIG. 9, the head holder 135 is provided with electrical terminals 136 and 137, which can be electrically connected to the electrical terminals 133 and 134 of the ink cartridges 2*a* and 2*b*. The electrical terminals 136 and 137 are connected to information readers 138 and 139 that can read out the information stored in the semiconductor storing means 127 and 132, respectively. The information readers 138 and 139 are connected to a controlling unit 11 (see FIG. 6) of a recording apparatus body via flexible cables 140.

Each of the semiconductor storing means 127 and 132 may be a read-only memory that is not capable of rewriting data. Alternatively, if each of the semiconductor storing means 127 and 132 is capable of rewriting data, the information reader 138 and 139 may have a function to rewrite data into the semiconductor storing means 127 and 132.

In detail, each of the semiconductor storing means 127 and 132 may be an IC chip. Alternatively, each of the semiconductor storing means 127 and 132 may be replaced with any other storing member such as a bar code or magnetic tape. In the case, the information readers 138 and 139 may be modified to match with the replaced storing member.

Figure 6:
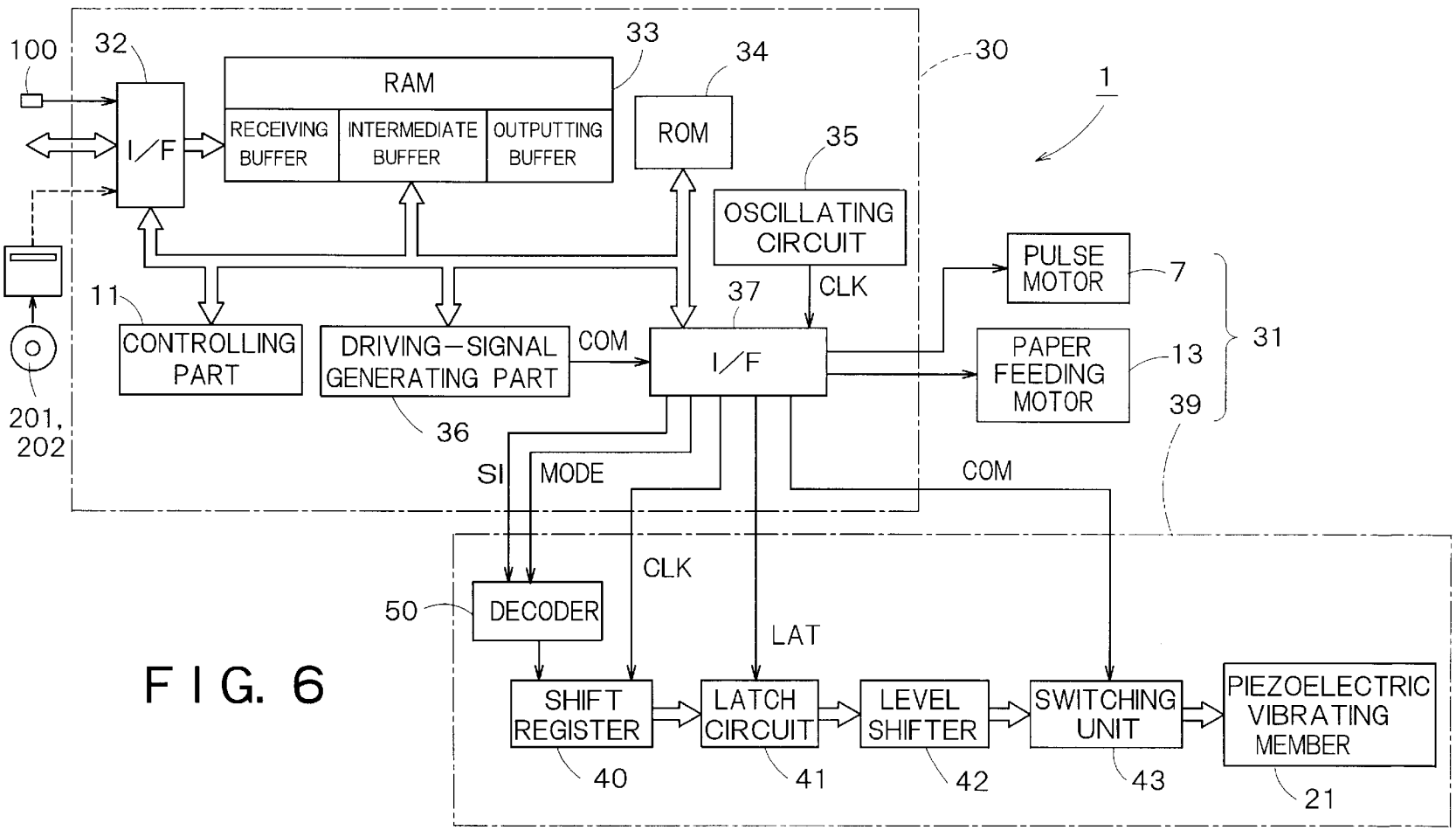
FIG. 6 is a schematic block diagram for explaining an electric structure of the recording head.

Then, an electric structure of the printer 1 is explained. As shown in FIG. 6, the ink-jetting printer 1 has a printer controller 30 and a printing engine 31.

The printer controller 30 has: an outside interface (outside I/F) 32, a RAM 33 which is able to temporarily store various data, a ROM 34 which stores a controlling program or the like, a controlling part 11 including CPU or the like, an oscillating circuit 35 for generating a clock signal, an driving-signal generating part 36 for generating an driving signal that is supplied into a recording head 4, and an inside interface (inside I/F) 37 that is adapted to send the driving signal, dot-pattern-data (bit-map-data) developed according to printing data (jetting data) or the like to the print engine 31.

The outside I/F 32 is adapted to receive printing data consisting of character codes, graphic functions, image data or the like from a host computer not shown or the like. In addition, a busy signal (BUSY) or an acknowledge signal (ACK) is adapted to be outputted to the host computer or the like through the outside I/F 32.

In addition, the outside I/F 32 in the embodiment is connected to an interface unit 100 such as a keyboard, which may function as an input part into which information of dense-thin desire of a user about a "fully-covering" control may be inputted by the user.

The RAM 33 has a receiving buffer, an intermediate buffer, an outputting buffer and a work memory not shown. The receiving buffer is adapted to receive the printing data through the outside I/F 32, and temporarily store the printing data. The intermediate buffer is adapted to store intermediate-code-data converted from the printing data by the controlling part 11. The outputting buffer is adapted to store dot-pattern-data which are data for printing obtained by decoding (translating) the intermediate-code-data (for example, level data).

The ROM 34 stores font data, graphic functions or the like in addition to the controlling program (controlling routine) for carrying out various data-processing operations. The ROM 34 also stores various setting data for maintenance operations.

The controlling part 11 is adapted to carry out various controlling operations according to the controlling program stored in the ROM 34. For example, the controlling part 11 reads out the printing data from the receiving buffer, converts the printing data into the intermediate-code-data, cause the intermediate buffer to store the intermediate-code-data. Then, the controlling part 11 analyzes the intermediate-code-data in the intermediate buffer and develops (decodes) the intermediate-code-data into the dot-pattern-data with reference to the font data and the graphic functions or the like stored in the ROM 34. Then, the controlling part 11 carries out necessary decorating operations to the dot-pattern-data, and thereafter causes the outputting buffer to store the dot-pattern-data.

When the dot-pattern-data corresponding to one line recorded by one main scanning of the recording head 4 are obtained, the dot-pattern-data are outputted to an electric driving system 39 of the recording head 4 from the outputting buffer through the inside I/F 37 in turn. Then, the carriage 5 is moved in the main scanning direction, that is, the recording operation for the one line is conducted. When the dot-pattern-data corresponding to the one line are outputted from the outputting buffer, the intermediate-code-data that has been developed are deleted from the intermediate buffer, and the next developing operation starts for the next intermediate-code-data.

In addition, the controlling part 11 controls a maintenance operation (a recovering operation) conducted before the recording operation by the recording head 4.

The print engine 31 includes a paper feeding motor 13 as a paper feeding mechanism, a pulse motor 7 as a head scanning mechanism, and an electric driving system 39 of the recording head 4.

Then, the electric driving system 39 of the recording head 4 is explained. As shown in FIG. 6, the electric driving system 39 includes decoders 50, shift registers 40, latch circuits 41, level shifters 42 and switching units 43 and the piezoelectric vibrating members 21, which are electrically connected in the order shown. The decoders 50 correspond to the respective nozzles 17 of the recording head 4, respectively. Similarly, the shift registers 40 correspond to the respective nozzles 17, the latch circuits 41 correspond to the respective nozzles 17, the level shifters 42 correspond to the respective nozzles 17, and the switching units 43 correspond the respective nozzles 17, respectively. In addition, the piezoelectric vibrating members 21 also correspond to the respective nozzles 17 of the recording head 4, respectively.

In the electric driving system 39, when a pulse-selecting datum (SP datum) supplied to a switching unit 43 is "1", the switching unit 43 is closed (connected) and a pulse-wave in the driving signal is directly supplied to a corresponding piezoelectric vibrating member 21. Thus, the piezoelectric vibrating member 21 deforms according to the pulse-wave of the driving signal. On the other hand, when a pulse-selecting datum (SP datum) supplied to a switching unit 43 is "0", the switching unit 43 is opened (unconnected) and the driving signal is not supplied to a corresponding piezoelectric vibrating member 21.

As described above, based on the pulse-selecting data, the driving signal may be selectively supplied to each piezoelectric vibrating member 21. Thus, dependently on given pulse-selecting data, a drop of the ink may be jetted from a nozzle 17 or a meniscus of ink may be caused to minutely vibrate.

Herein, in the embodiment, three different modes of full-jetting operations can be achieved, dependently on the respective colors of ink and respective types of recording paper.

The full-jetting operation is carried out as a "fully-covering" operation. In the embodiment, for respective full-jetting operations of the respective colors of ink, a common driving signal COM, which is shown in FIG. 10, is adapted to be generated by the driving-signal generating circuit 36.

Figure 10:
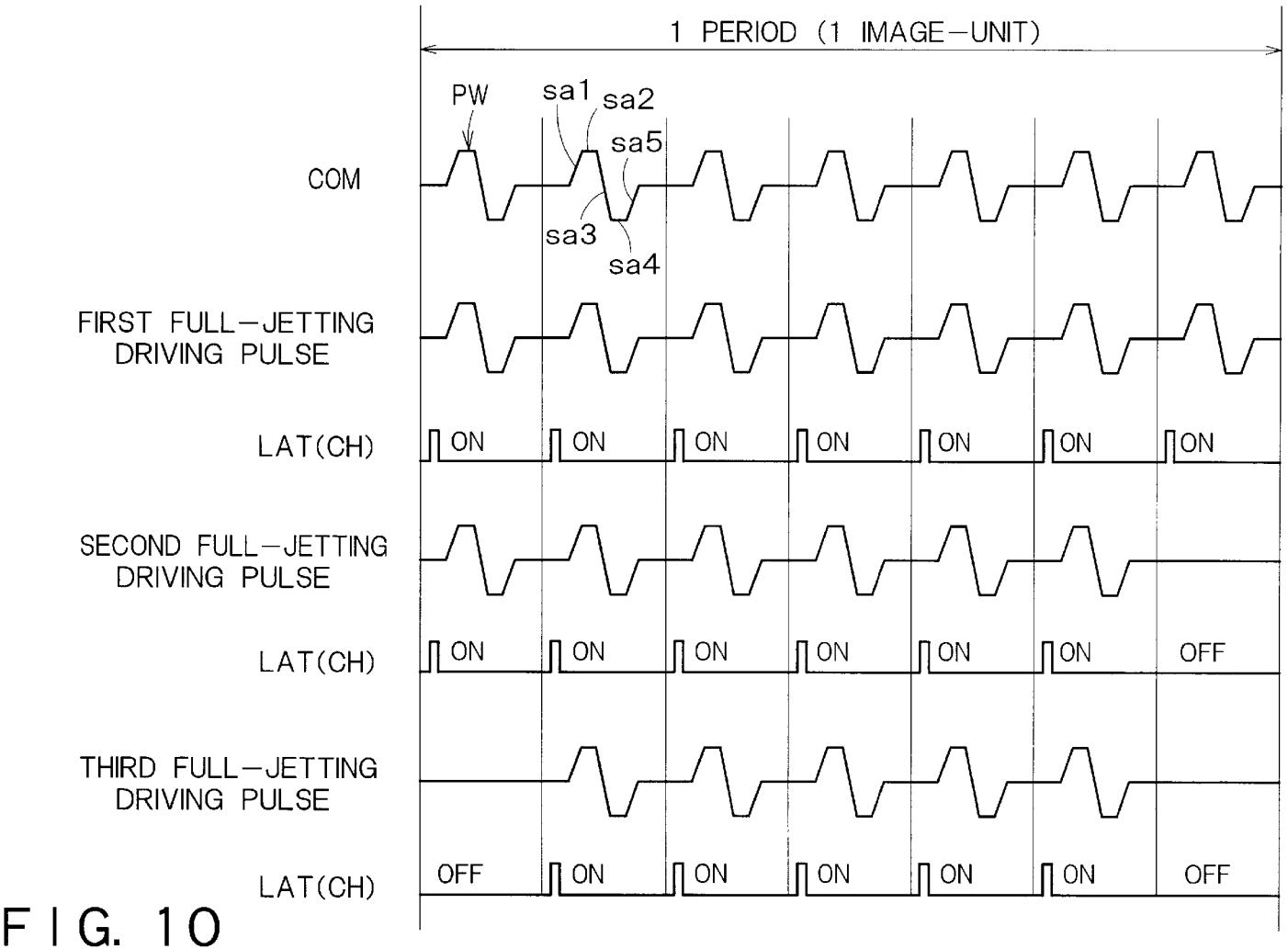
FIG. 10 is a graph of a plurality of full-jetting driving pulses which respectively correspond to a plurality of jetting modes.

As shown in FIG. 10, the common driving signal COM is a periodical signal including seven the same pulse-waves PW at the same intervals within a period thereof, which period corresponds to one image unit (one pixel; for example 360×360 dpi).

Each pulse-wave PW includes: a first potential-rising element sa1 for supplying to a piezoelectric vibrating member 21 a potential for causing a pressure chamber 22 to expand so as to reduce a pressure in the pressure chamber 22, a first potential-maintaining element sa2 for supplying to the piezoelectric vibrating member 21 a potential for maintaining the state wherein the pressure in the pressure chamber 22 is reduced, a first potential-falling element sa3 for supplying to the piezoelectric vibrating member 21 a potential for causing the pressure chamber 22 to contract so as to increase the pressure in the pressure chamber 22, a second potential-maintaining element sa4 for supplying to the piezoelectric vibrating member 21 a potential for maintaining the state wherein the pressure in the pressure chamber 22 is increased, and a second potential-rising element sa5 for supplying to the piezoelectric vibrating member 21 a potential for returning the state of the pressure chamber 22 to an original state thereof.

In the embodiment, the ink-jetting recording apparatus 1 is adapted to jet a drop of ink whose weight is 7 ng by means of the above one pulse-wave PW, no matter what color the ink is.

Selection of the pulse-waves PW to be supplied to corresponding piezoelectric vibrating members 21 in the respective full-jetting operations for the respective colors of ink is conducted by the controlling part 11.

That is, the controlling part 11 is adapted to set a selected jetting mode from a first, a second and a third jetting modes, dependently on each color of ink and/or each type of recording paper 12, as a jetting-mode setting unit.

Herein, the first jetting mode is a mode for conducting a "fully-covering" operation of the black ink onto a type of recording paper that has a lower ink-expansion characteristic. The second jetting mode is a mode for conducting a "fully-covering" operation of any other color ink onto the type of recording paper that has a lower ink-expansion characteristic. The third jetting mode is a mode for conducting a "fully-covering" operation of any ink onto a type of recording paper that has a higher ink-expansion characteristic.

In the embodiment, the information about characteristics of the respective colors of ink (liquid information) are adapted to be obtained from the semiconductor storing means 127 and 132 of the ink cartridges 2*a* and 2*b* mounted on the recording head 4 through the information reader 138 and 139 (see FIG. 9).

Then, if a selected jetting mode is the first jetting mode, the corresponding decoder 50 is adapted to generate pulse-selecting data for one image unit (1111111), based on printing data designating a "fully-covering" control. Similarly, if a selected jetting mode is the second jetting mode, the corresponding decoder 50 is adapted to generate pulse-selecting data for one image unit (1111110), based on printing data designating a "fully-covering" control. Furthermore, if a selected jetting mode is the third jetting mode, the corresponding decoder 50 is adapted to generate pulse-selecting data for one image unit (0111110), based on printing data designating a "fully-covering" control.

Then, the corresponding switching unit 43 generates a full-jetting driving pulse (pulse-row), based on respective bits of the pulse-selecting data generated based on the selected jetting mode and the common jetting-driving signal COM, as a driving-pulse generator. In detail, the respective bits of the pulse-selecting data are latched in the corresponding latch circuit 41 in turn every when a LAT signal (CH signal) is supplied, so that a rectangular-pulse row corresponding to the period of the common jetting-driving signal COM is generated. Then, the full-jetting driving pulse is defined as an AND signal of the rectangular-pulse row and the common jetting-driving signal COM by the switching unit 43. In addition, the switching unit 43 is adapted to cause the corresponding piezoelectric vibrating member 21 (pressure-changing unit) to operate based on the full-jetting driving pulse, as a full-jetting main controller.

As seen from the above explanation, according to the embodiment, weights (amounts) of ink jetted from the nozzles by the respective full-jetting driving pulses are different from each other, dependently on the respective selected jetting modes. That is, if the first full-jetting driving pulse is used, an amount of ink being 7 ng×7=49 ng is jetted, if the second full-jetting driving pulse is used, an amount of ink being 7 ng×6=42 ng is jetted, and if the third full-jetting driving pulse is used, an amount of ink being 7 ng×5=35 ng is jetted.

As described above, by making the actual weights of jetted ink different, a uniform "fully-covering" can be easily achieved even if the respective colors of ink have various liquid-expansion characteristics to the respective types of recording papers.

Then, an operation of the printer 1 is explained.

When electric power is supplied to the printer 1, a necessary initializing operation is conducted at first. Then, the recording head 4 waits (stands by) at the waiting position (as shown in FIG. 3A). After printing data corresponding to one line is outputted from the outputting buffer of the RAM 33, the recording head 4 conducts a maintenance operation (recovering operation) before a recording operation for the one line.

The controlling part 11 sets a selected jetting mode from the plurality of jetting modes, for each color of ink, as a jetting-mode setting unit. In the case, the characteristics of the recording papers 12 are taken into consideration as well. Thus, when the recording paper 12 has a low ink-expansion characteristic (wherein jetted ink is less oozy and a recorded line tends to be thinner), the controlling part 11 selects the first jetting mode as s selected jetting mode for the black ink and the second jetting mode as a selected jetting mode for any other color ink. When the recording paper 12 has a high ink-expansion characteristic (wherein jetted ink is relatively oozy and a recorded line tends to be thicker), the controlling part 11 selects the third jetting mode as s selected jetting mode for any ink.

As described above, setting of the selected jetting mode is automatically conducted by the controlling part 11, but may be suitably changed or modified via the interface unit 100.

After a selected jetting mode is selected and set, the controlling part 11 outputs controlling information (jetting-mode information) to the corresponding decoders 50.

On the other hand, the driving-signal generating circuit 36 generates the common driving signal COM (see FIG. 10) including seven the same pulse-waves PW within one period thereof, independently of the respective selected jetting modes.

Each decoder 50 generates pulse-selecting data based on printing data (level information). In particular, each decoder 50 has a table defining the respective pulse-selecting data (SP data) corresponding to level information of the highest density (which corresponds to the "fully-covering") for the respective jetting modes. Thus, when the "fully-covering" control is conducted, according to the controlling information from the controlling part 11, each decoder 50 generates (decodes) a pulse-selecting data corresponding to the selected jetting mode.

In detail, each decoder 50 generates pulse-selecting data (1111111) correspondingly to the level information of the highest density for the first jetting mode. For the second jetting mode, each decoder 50 generates pulse-selecting data (1111110) correspondingly to the level information of the highest density. For the third jetting mode, each decoder 50 generates pulse-selecting data (0111110) correspondingly to the level information of the highest density.

Then, each switching unit 43 (driving-pulse supplying unit) refers to the contents i.e. the respective bits of the pulse-selecting data every timing defined by the latch signal (LAT) or the channel signal (CH). Then, if a bit thereof is "1", each switching unit 43 supplies the pulse-wave PW during a term corresponding to the bit to each piezoelectric vibrating member 21.

As a result, if the first jetting mode is selected, a small drop of ink is jetted seven times during one period of the common driving signal COM (corresponding to one image unit). The weight of the small drop of ink is set to be 7 ng, so that an amount of ink being 7 ng×7=49 ng is jetted per one image unit.

In addition, if the second jetting mode is selected, a small drop of ink is jetted six times during one period of the common driving signal COM (corresponding to one image unit). The weight of the small drop of ink is set to be 7 ng, so that an amount of ink being 7 ng×6=42 ng is jetted per one image unit.

Similarly, if the third jetting mode is selected, a small drop of ink is jetted five times during one period of the common driving signal COM (corresponding to one image unit). The weight of the small drop of ink is set to be 7 ng, so that an amount of ink being 7 ng×5=35 ng is jetted per one image unit.

As described above, according to the embodiment, the full-jetting driving pulse for the "fully-covering" operation is generated based on the selected jetting mode and the common jetting-driving signal. Thus, the full-jetting ("fully-covering") state can be controlled suitably for each of the colors of ink, even if the common jetting-driving signal COM is used.

Especially, since the weights of the ink jetted from the nozzles 17 based on the respective full-jetting driving pulses are different according to the respective jetting modes, a uniform "fully-covering" can be easily achieved while maintaining the same throughput and the same carriage scanning speed even if the respective colors of ink have various liquid-expansion characteristics to the respective types of recording papers 12.

That is, when the ink-expansion characteristic is high, an amount of jetted ink may be set to be smaller in order to prevent the jetted ink from oozing. On the other hand, when the ink-expansion characteristic is low, an amount of jetted ink may be set to be larger in order to achieve a sufficient "fully-covering" surely.

In addition, since the common jetting-driving signal COM is the periodical signal including a plurality of (in the case, seven) the same pulse-waves PW within its one period, and each switching unit 43 (driving-pulse generator) generates the rectangular-pulse row corresponding to the period of the common jetting-driving signal COM based on the selected jetting mode and generates an AND signal of the rectangular-pulse row and the common jetting-driving signal COM as the full-jetting ("fully-covering") driving pulse, the process of generating the driving pulse is very easy.

In addition, since the weight of the small drop of ink is adjusted to be 7 ng for all the jetting modes, it is unnecessary to change a "Bi-D adjusting value" even if a double-direction (forth and back) printing is conducted. If the weight of a drop of ink is greatly varied, it is necessary to adjust again the "Bi-D adjusting value".

Herein, the above embodiment can be expressed as follows.

That is, in the above embodiment: the plurality of jetting modes include a first jetting mode and a second jetting mode; the common jetting-driving signal is a periodical signal including n the same pulse-waves within a period thereof; the driving-pulse generator is adapted to generate, based on the common jetting-driving signal, a full-jetting driving-pulse including only p pulse-waves when the selected jetting mode is the first jetting mode, p being one or more, and a full-jetting driving-pulse including only q pulse-waves when the selected jetting mode is the second jetting mode, q being more than p and not more than n; and n=7, p=6, and q=7.

The above embodiment can be also expressed as follows.

That is, in the above embodiment: the plurality of jetting modes include a first jetting mode and a third jetting mode; the common jetting-driving signal is a periodical signal including n the same pulse-waves within a period thereof; the driving-pulse generator is adapted to generate, based on the common jetting-driving signal, a full-jetting driving-pulse including only p pulse-waves when the selected jetting mode is the first jetting mode, p being one or more, and a full-jetting driving-pulse including only q pulse-waves when the selected jetting mode is the third jetting mode, q being more than p and not more than n; and n=7, p=5, and q=7.

The values of p and q can be suitably changed by an inputting operation via the interface unit 100 such as a keyboard. That is, when desired dense-thin information of a user is inputted through the interface unit 100, a "fully-covering" control based on the dense-thin desire of the user can be achieved.

In order to handle wider dense-thin desire of a user, it is preferable that the value of n is greater and that the value of q is less than n. In the case, if the user desires a mode of much higher density, the apparatus can provide the mode by increasing the value of q to the value of n.

One or more pulse-waves PW in one period of the jetting-driving signal that are selected correspondingly to the respective values of p and q may be set in advance or may be set through the interface unit 100. However, if a double-direction (forth and back) printing is conducted, it is preferable that one or more pulse-waves PW in one period of the jetting-driving signal selected correspondingly to the respective values of p and q are symmetric with respect to time in the period, in order to make readjustment of the "Bi-D adjusting value" unnecessary.

In addition, in the above embodiment, the information of the respective colors of ink is read from the semiconductor storing means 127 and 132 of the ink cartridges 2*a* and 2*b*. However, the information of the respective colors of ink that may be used for selection of the selected jetting mode may be obtained by any other way. For example, if the recording apparatus uses only predetermined kinds or colors of ink, information of the predetermined kinds or colors of ink may be stored in the ROM 34 in advance. In another case, information of respective kinds of ink may be inputted through the interface unit 100.

If information of a kind of ink is inputted through the interface unit 100, ink-expansion characteristic of the kind of ink may be directly inputted. Alternatively, if a corresponding table between stock-numbers or the like of respective kinds of ink and ink-expansion characteristics is prepared in the ROM 34 or the like, the stock number or the like of a kind of ink may be inputted by a user.

Similarly, if the recording apparatus uses only predetermined kinds of recording papers 12, information of the predetermined kinds of recording papers 12 may be stored in the ROM 34 in advance. In another case, information of respective kinds of recording papers may be inputted through the interface unit 100.

If information of a kind of recording paper is inputted through the interface unit 100, ink-expansion characteristic of the kind of recording paper may be directly inputted. Alternatively, if a corresponding table between stock-numbers or the like of respective kinds of recording paper and ink-expansion characteristics is prepared in the ROM 34 or the like, the stock number or the like of a kind of recording paper may be inputted by a user.

Second Embodiment

Next, a second embodiment of the invention is explained. The structure of the second embodiment is substantially the same as the above first embodiment, except for following points. In the second embodiment, the same numeral references correspond to the same elements as the first embodiment.

In the second embodiment, the ROM 34 (or EEPROM not shown) stores a jetting-amount-adjusting mode that has been set for each of the plurality of nozzles 17, as a mode storing unit.

In addition, in the embodiment, three different modes of full-jetting operations can be achieved, dependently on the respective characteristics of jetting a drop of ink in the respective nozzles 17.

The full-jetting operation is carried out as a "fully-covering" operation. In the embodiment, for respective full-jetting operations from the respective nozzles 17, a common driving signal COM, which is shown in FIG. 11, is adapted to be generated by the driving-signal generating circuit 36.

Figure 11:
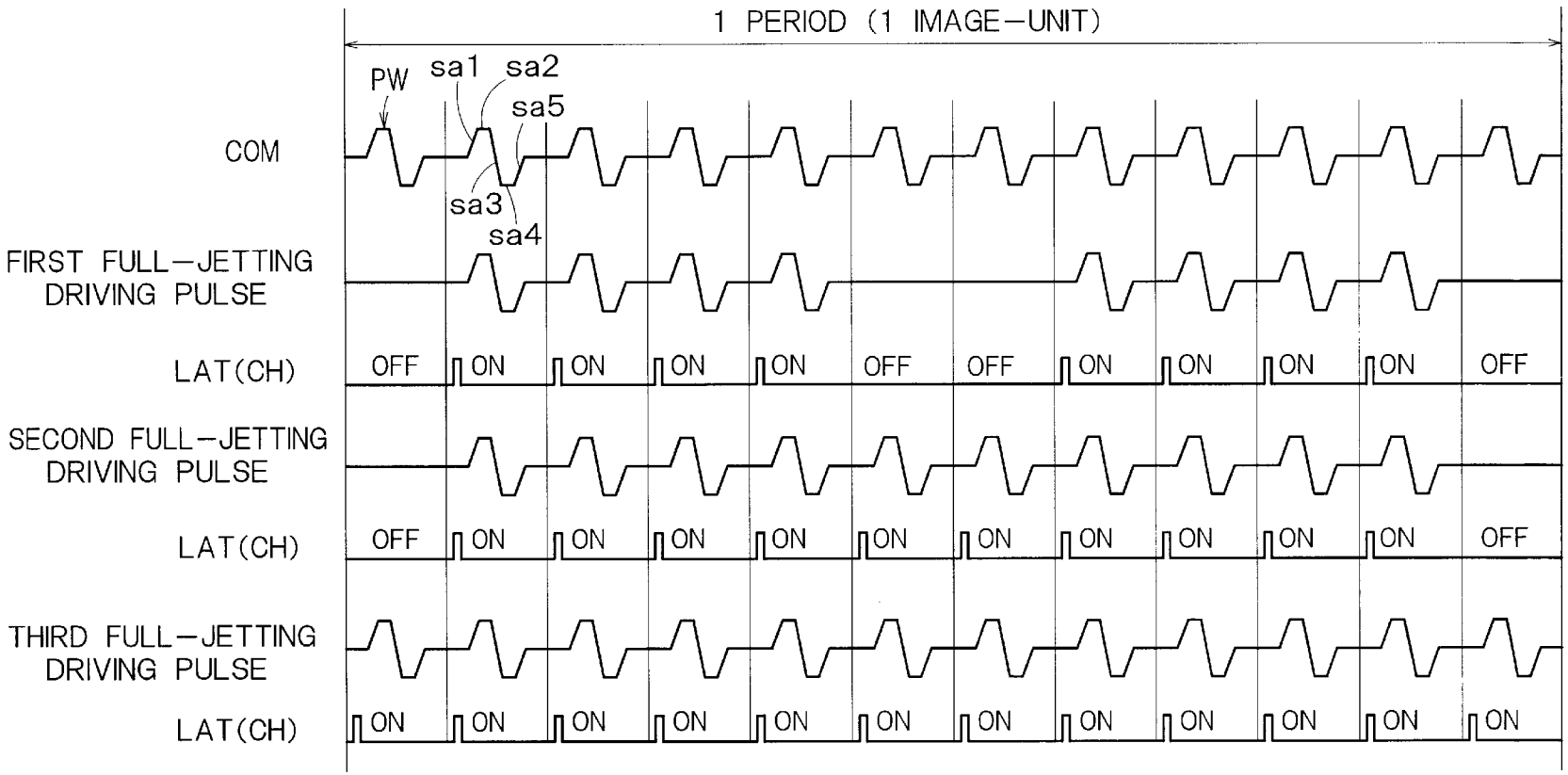
FIG. 11 is a graph of a plurality of full-jetting driving pulses which respectively correspond to a plurality of jetting-amount-adjusting modes.

As shown in FIG. 11, the common driving signal COM is a periodical signal including twelve the same pulse-waves PW at the same intervals within a period thereof, which period corresponds to one image unit (one pixel; for example 360×360 dpi).

Each pulse-wave PW includes: a first potential-rising element sa1 for supplying to a piezoelectric vibrating member 21 a potential for causing a pressure chamber 22 to expand so as to reduce a pressure in the pressure chamber 22, a first potential-maintaining element sa2 for supplying to the piezoelectric vibrating member 21 a potential for maintaining the state wherein the pressure in the pressure chamber 22 is reduced, a first potential-falling element sa3 for supplying to the piezoelectric vibrating member 21 a potential for causing the pressure chamber 22 to contract so as to increase the pressure in the pressure chamber 22, a second potential-maintaining element sa4 for supplying to the piezoelectric vibrating member 21 a potential for maintaining the state wherein the pressure in the pressure chamber 22 is increased, and a second potential-rising element sa5 for supplying to the piezoelectric vibrating member 21 a potential for returning the state of the pressure chamber 22 to an original state thereof.

In the embodiment, by means of the above one pulse-wave PW, from the respective nozzles 17, the ink-jetting recording apparatus 1 is adapted to jet a drop of ink whose weight is for example 3 to 5 ng and is dependent on a characteristic of the ink, respective mechanical characteristics of the respective nozzles 17, manufacturing errors, and so on.

Selection of the pulse-waves PW to be supplied to corresponding piezoelectric vibrating members 21 in the respective full-jetting operations for the respective nozzles 17 is conducted by the controlling part 11 based on respective jetting-amount-adjusting modes.

Herein, a first, a second or a third adjusting mode is set and stored in the ROM 34 for each nozzle 17.

The first adjusting mode is a jetting-amount-adjusting mode for a nozzle from which a larger amount of ink tends to be jetted. The second adjusting mode is a jetting-amount-adjusting mode for a nozzle from which an intermediate amount of ink tends to be jetted. The third adjusting mode is a jetting-amount-adjusting mode for a nozzle from which a smaller amount of ink tends to be jetted.

In the embodiment, when a jetting-amount-adjusting mode is the first adjusting mode, the corresponding decoder 50 is adapted to generate pulse-selecting data for one image unit (011110011110), based on printing data designating a "fully-covering" control. Similarly, when a jetting-amount-adjusting mode is the second adjusting mode, the corresponding decoder 50 is adapted to generate pulse-selecting data for one image unit (011111111110), based on printing data designating a "fully-covering" control. Furthermore, when a jetting-amount-adjusting mode is the third adjusting mode, the corresponding decoder 50 is adapted to generate pulse-selecting data for one image unit (111111111111), based on printing data designating a "fully-covering" control.

Then, the corresponding switching unit 43 generates a full-jetting driving pulse (pulse-row), based on respective bits of the pulse-selecting data generated based on the jetting-amount-adjusting mode and the common jetting-driving signal COM, as a driving-pulse generator. In detail, the respective bits of the pulse-selecting data are latched in the corresponding latch circuit 41 in turn every when a LAT signal (CH signal) is supplied, so that a rectangular-pulse row corresponding to the period of the common jetting-driving signal COM is generated. Then, the full-jetting driving pulse is defined as an AND signal of the rectangular-pulse row and the common jetting-driving signal COM by the switching unit 43. In addition, the switching unit 43 is adapted to cause the corresponding piezoelectric vibrating member 21 (pressure-changing unit) to operate based on the full-jetting driving pulse, as a full-jetting main controller.

As seen from the above explanation, according to the embodiment, the numbers of jetting a drop of ink from the nozzles by the respective full-jetting driving pulses are different dependently on the respective jetting-amount-adjusting modes. That is, if the first full-jetting driving pulse is used for a nozzle from which a larger amount of ink tends to be jetted, for example, from which an amount (weight) of ink being 5 ng is jetted by means of the above one pulse-wave PW, an amount of ink being 5 ng×8=40 ng is jetted from the nozzle per one image unit (pixel). If the second full-jetting driving pulse is used for a nozzle from which a relatively intermediate amount of ink tends to be jetted, for example, from which an amount (weight) of ink being 4 ng is jetted by means of the above one pulse-wave PW, an amount of ink being 4 ng×10=40 ng is jetted from the nozzle per one image unit. If the third full-jetting driving pulse is used for a nozzle from which a smaller amount of ink tends to be jetted, for example, from which an amount (weight) of ink being 3.3 ng is jetted by means of the above one pulse-wave PW, an amount of ink being 3.3 ng×12=39.6 ng is jetted from the nozzle per one image unit.

As described above, by making the numbers of jetting a drop of ink per one image unit (pixel) different, a uniform "fully-covering" can be easily achieved even if respective drops of ink jetted from the respective nozzles have various weights.

Then, an operation of the printer 1 in the embodiment is explained.

When electric power is supplied to the printer 1, a necessary initializing operation is conducted at first. Then, the recording head 4 waits (stands by) at the waiting position (as shown in FIG. 3A). After printing data corresponding to one line is outputted from the outputting buffer of the RAM 33, the recording head 4 conducts a maintenance operation (recovering operation) before a recording operation for the one line.

The controlling part 11 outputs respective controlling information (jetting-amount-adjusting mode information) for the respective nozzles 17 to the respective decoders 50, according to the respective jetting-amount-adjusting modes for the respective nozzles 17 stored in the ROM 34.

On the other hand, the driving-signal generating circuit 36 generates the common driving signal COM (see FIG. 11) including twelve, the same pulse-waves PW within one period thereof.

Each decoder 50 generates pulse-selecting data based on printing data (level information). In particular, each decoder 50 has a table defining the respective pulse-selecting data (SP data) corresponding to level information of the highest density (which corresponds to the "fully-covering") for the respective jetting-amount-adjusting modes. Thus, when the "fully-covering" control is conducted, according to the controlling information from the controlling part 11, each decoder 50 generates (decodes) a pulse-selecting data corresponding to a jetting-amount-adjusting mode that has been set for each nozzle 17.

In detail, each decoder 50 generates pulse-selecting data (011110011110) correspondingly to the level information of the highest density for the first adjusting mode. For the second adjusting mode, each decoder 50 generates pulse-selecting data (011111111110) correspondingly to the level information of the highest density. For the third adjusting mode, each decoder 50 generates pulse-selecting data (111111111111) correspondingly to the level information of the highest density.

Then, each switching unit 43 (driving-pulse supplying unit) refers to the contents i.e. the respective bits of the pulse-selecting data every timing defined by the latch signal (LAT) or the channel signal (CH). Then, if a bit thereof is "1", each switching unit 43 supplies the pulse-wave PW during a term corresponding to the bit to each piezoelectric vibrating member 21.

As a result, if the first adjusting mode has been set, a small drop of ink is jetted eight times during one period of the common driving signal COM (corresponding to one image unit). The nozzle 17 for which the first adjusting mode has been set tends to jet a larger amount of ink, and the weight of the small drop of ink jetted from the nozzle 17 is substantially 5 ng in the embodiment. Thus, an amount of ink being 5 ng×8=40 ng is jetted per one image unit.

In addition, if the second adjusting mode has been set, a small drop of ink is jetted ten times during one period of the common driving signal COM (corresponding to one image unit). The nozzle 17 for which the second adjusting mode has been set tends to jet a relatively intermediate amount of ink, and the weight of the small drop of ink jetted from the nozzle 17 is substantially 4 ng in the embodiment. Thus, an amount of ink being 4 ng×10=40 ng is jetted per one image unit.

Similarly, if the third adjusting mode has been set, a small drop of ink is jetted twelve times during one period of the common driving signal COM (corresponding to one image unit). The nozzle 17 for which the third adjusting mode has been set tends to jet a smaller amount of ink, and the weight of the small drop of ink jetted from the nozzle 17 is substantially 3.3 ng in the embodiment. Thus, an amount of ink being 3.3 ng×12≈40 ng is jetted per one image unit.

As described above, according to the embodiment, the full-jetting driving pulse for the "fully-covering" operation is generated based on the jetting-amount-adjusting mode and the common jetting-driving signal COM. Thus, the full-jetting ("fully-covering") state can be controlled suitably for each of the nozzles 17, even if the common jetting-driving signal COM is used and characteristics of jetting a drop of ink are different dependently on the respective nozzles 17, for example because of a reason regarding manufacture of the recording head 4 or the like.

In addition, since the common jetting-driving signal COM is the periodical signal including a plurality of (in the case, twelve) the same pulse-waves PW within its one period, and each switching unit 43 (driving-pulse generator) generates the rectangular-pulse row corresponding to the period of the common jetting-driving signal COM based on the jetting-amount-adjusting mode and generates an AND signal of the rectangular-pulse row and the common jetting-driving signal COM as the full-jetting ("fully-covering") driving pulse, the process of generating the driving pulse is very easy.

Herein, the above second embodiment can be expressed as follows.

That is, in the above second embodiment: the jetting-amount-adjusting mode can be the first adjusting mode, the second adjusting mode, and the third adjusting mode; the common jetting-driving signal is a periodical signal including n the same pulse-waves within a period thereof; the driving-pulse generator is adapted to generate, based on the common jetting-driving signal, a full-jetting driving-pulse including only p pulse-waves when the jetting-amount-adjusting mode is the first adjusting mode, p being one or more, a full-jetting driving-pulse including only q pulse-waves when the jetting-amount-adjusting mode is the second adjusting mode, q being more than p and less than n, and a full-jetting driving-pulse including only r pulse-waves when the jetting-amount-adjusting mode is the third adjusting mode, r being more than q and not more than n; and n=12, p=8, q=10, and r=12.

The values of p, q and r can be suitably changed based on various characteristics of the nozzles 17 or the like. The number of the jetting-amount-adjusting modes may be 4 or more.

If a double-direction (forth and back) printing is conducted, in order to make adjustment of the "Bi-D adjusting value" unnecessary, it is preferable that one or more pulse-waves PW in one period of the jetting-driving signal selected correspondingly to the respective values of p, q and r are symmetric with respect to time in the period.

In addition, as described above, the characteristics of jetting a drop of ink in the nozzles 17 forming the same nozzle row tend to be the same, because of a reason regarding manufacture of the head member 4 or the like. Thus, instead of conducting a full jetting control for each of the nozzles 17 by using each jetting-amount-adjusting mode, a full jetting control may be conducted for each of the nozzle rows by using each jetting-amount-adjusting mode.

In addition, the above embodiments can be variously modified in a scope of claimed invention.

For example, a pressure-generating member for changing the volume of the pressure chamber 22 is not limited to the piezoelectric vibrating member 21. For example, a pressure-generating member can consist of a magnetostrictive device. In the case, the magnetostrictive device causes the pressure chamber 22 to expand and contract, thus, changes the pressure of the ink in the pressure chamber 22. Alternatively, a pressure-generating member can consist of a heating device. In the case, the heating device causes an air bubble in the pressure chamber 22 to expand and contract, thus, changes the pressure of the ink in the pressure chamber 22.

In addition, as described above, the printer controller 30 can be materialized by a computer system. A program for materializing the above one or more components in a computer system, and a storage unit 201 storing the program and capable of being read by a computer, are intended to be protected by this application.

In addition, when the above one or more components may be materialized in a computer system by using a general program such as an OS, a program including a command or commands for controlling the general program, and a storage unit 202 storing the program and capable of being read by a computer, are intended to be protected by this application.

Each of the storage units 201 and 202 can be not only a substantial object such as a floppy disk or the like, but also a network for transmitting various signals.

The above description is given for the ink-jetting printer as a liquid jetting apparatus of the embodiment according to the invention. However, this invention is intended to apply to general liquid jetting apparatuses widely. A liquid may be glue, nail polish or the like, instead of the ink.

What is claimed is:

1. A liquid jetting apparatus comprising:

a head member having a nozzle, a pressure-changing unit that can cause pressure of liquid in the nozzle to change in such a manner that the liquid is jetted from the nozzle, a jetting-mode setting unit that can set a selected jetting mode from a plurality of jetting modes, a driving-signal generator that can generate a common jetting-driving signal, a driving-pulse generator that can generate a full-jetting driving pulse, based on the selected jetting mode and the common jetting-driving signal, and a full-jetting main controller that can cause the pressure-changing unit to operate, based on the full-jetting driving pulse, wherein the full-jetting driving pulse is used to fully cover an image unit of a recording medium with the liquid jetted from the nozzle, and wherein respective full-jetting drive pulses are different according to respective jetting modes.

2. A liquid jetting apparatus according to claim 1, wherein:

weights of the liquid jetted from the nozzle based on respective full-jetting driving pulses are different according to respective jetting modes.

3. A liquid jetting apparatus according to claim 2 wherein:

the common jetting-driving signal is a periodical signal including a plurality of same pulse-waves within a period thereof, and the driving-pulse generator is adapted to generate a rectangular-pulse row corresponding to the period of the common jetting-driving signal based on the selected jetting mode, and generate an AND signal of the rectangular-pulse row and the common jetting-driving signal as the full-jetting driving pulse.

4. A liquid jetting apparatus according to claim 1, wherein:

the plurality of jetting modes include a first jetting mode and a second jetting mode, the common jetting-driving signal is a periodical signal including n same pulse-waves within a period thereof, and the driving-pulse generator is adapted to generate, based on the common jetting-driving signal, a full-jetting driving-pulse including only p pulse-waves when the selected jetting mode is the first jetting mode, p being one or more, and a full-jetting driving-pulse including only q pulse-waves when the selected jetting mode is the second jetting mode, q being more than p and not more than n.

5. A liquid jetting apparatus according to claim 4, wherein:

a weight of the liquid jetted from the nozzle based on the one pulse-wave is 7 ng.

6. A liquid jetting apparatus according to claim 4, wherein:

$p=n-1$ or $n-2$, and $q=n$.

7. A liquid jetting apparatus according to claim 4, wherein:

the jetting-mode setting unit has an input part into which desired dense-thin information is inputted by a user, and a jetting-mode setting main part that is adapted to set a selected jetting mode based on the desired dense-thin information inputted into the input part.

8. A liquid jetting apparatus according to claim 7, wherein:

the jetting-mode setting main part can change at least one of p and q, based on the desired dense-thin information inputted into the input part.

9. A liquid jetting apparatus according to claim 4, wherein:

the jetting-mode setting unit sets as a selected jetting mode the first jetting mode when the liquid has a high liquid-expansion characteristic, and the second jetting mode when the liquid has a low liquid-expansion characteristic.

10. A liquid jetting apparatus according to claim 9, wherein:

the jetting-mode setting unit has an information reader that can obtain liquid information regarding the liquid included in a liquid cartridge from the liquid cartridge, the liquid cartridge being mounted on the head member, and a jetting-mode setting main part that is adapted to set a selected jetting mode based on the liquid information obtained by the information reader.

11. A liquid jetting apparatus according to claim 4, wherein:

the jetting-mode setting unit sets as a selected jetting mode the first jetting mode when a medium onto which the liquid is jetted has a high liquid-expansion characteristic, and the second jetting mode when the medium onto which the liquid is jetted has a low liquid-expansion characteristic.

12. A liquid jetting apparatus according to claim 1, wherein:

the pressure-changing unit has a piezoelectric vibrating member.

13. A liquid jetting apparatus according to claim 1, wherein:

the liquid is an ink.

14. A controlling unit for controlling a liquid jetting apparatus including a head member having a nozzle, and a pressure-changing unit that can cause pressure of liquid in the nozzle to change in such a manner that the liquid is jetted from the nozzle, comprising a jetting-mode setting unit that can set a selected jetting mode from a plurality of jetting modes, a driving-signal generator that can generate a common jetting-driving signal, a driving-pulse generator that can generate a full-jetting driving pulse, based on the selected jetting mode and the common jetting-driving signal, and a full-jetting main controller that can cause the pressure-changing unit to operate, based on the full-jetting driving pulse, wherein the full-jetting driving pulse is used to fully cover an image unit of a recording medium with the liquid jetted from the nozzle, and wherein respective full-jetting drive pulses are different according to respective jetting modes.

15. A controlling unit according to claim 14, wherein:

weights of the liquid jetted from the nozzle based on respective full-jetting driving pulses are different according to respective jetting modes.

16. A controlling unit according to claim 15, wherein:

the common jetting-driving signal is a periodical signal including a plurality of same pulse-waves within a period thereof, and the driving-pulse generator is adapted to generate a rectangular-pulse row corresponding to the period of the common jetting-driving signal based on the selected jetting mode, and generate an AND signal of the rectangular-pulse row and the common jetting-driving signal as the full-jetting driving pulse.

17. A controlling unit according to claim 14, wherein:

the plurality of jetting modes include a first jetting mode and a second jetting mode, the common jetting-driving signal is a periodical signal including n same pulse-waves within a period thereof, and the driving-pulse generator is adapted to generate, based on the common jetting-driving signal, a full-jetting driving-pulse including only p pulse-waves when the selected jetting mode is the first jetting mode, p being one or more, and a full-jetting driving-pulse including only q pulse-waves when the selected jetting mode is the second jetting mode, q being more than p and not more than n.

18. A controlling unit according to claim 17, wherein:

a weight of the liquid jetted from the nozzle based on the one pulse-wave is 7 ng.

19. A controlling unit according to claim 17, wherein:

$p=n-1$ or $n-2$, and $q=n$.

20. A controlling unit according to claim 17, wherein:

the jetting-mode setting unit has an input part into which desired dense-thin information is inputted by a user, and a jetting-mode setting main part that is adapted to set a selected jetting mode based on the desired dense-thin information inputted into the input part.

21. A controlling unit according to claim 20, wherein:

the jetting-mode setting main part can change at least one of p and q, based on the desired dense-thin information inputted into the input part.

22. A controlling unit according to claim 17, wherein:

the jetting-mode setting unit sets as a selected jetting mode the first jetting mode when the liquid has a high liquid-expansion characteristic, and the second jetting mode when the liquid has a low liquid-expansion characteristic.

23. A controlling unit according to claim 22, wherein:

the jetting-mode setting unit has an information reader that can obtain liquid information regarding the liquid included in a liquid cartridge from the liquid cartridge, the liquid cartridge being mounted on the head member, and a jetting-mode setting main part that is adapted to set a selected jetting mode based on the liquid information obtained by the information reader.

24. A controlling unit according to claim 17, wherein:

the jetting-mode setting unit sets as a selected jetting mode the first jetting mode when a medium onto which the liquid is jetted has a high liquid-expansion characteristic, and the second jetting mode when the medium onto which the liquid is jetted has a low liquid-expansion characteristic.

25. A liquid jetting apparatus comprising a head member having a plurality of nozzles, a plurality of pressure-changing units each of which can cause pressure of liquid in each of the plurality of nozzles to change in such a manner that the liquid is jetted from the nozzle, a driving-signal generator that can generate a common jetting-driving signal, a mode storing unit that can store a jetting-amount-adjusting mode that has been set for each of the plurality of nozzles, a driving-pulse generator that can generate a full-jetting driving pulse for each of the plurality of nozzles, based on the jetting-amount-adjusting mode and the common jetting-driving signal, and a full-jetting main controller that can cause each of the plurality of pressure-changing units to operate, based on the full-jetting driving pulse, wherein the full-jetting driving pulses are used to fully cover an image unit of a recording medium with the liquid jetted from the nozzle, and wherein respective full-jetting driving pulses are different according to respective jetting-amount-adjusting modes.

26. A liquid jetting apparatus comprising a head member having a plurality of nozzles forming a plurality of nozzle rows, a plurality of pressure-changing units each of which can cause pressure of liquid in each of the plurality of nozzles to change in such a manner that the liquid is jetted from the nozzle, a driving-signal generator that can generate a common jetting-driving signal, a mode storing unit that can store a jetting-amount-adjusting mode that has been set for each of the plurality of nozzle rows, a driving-pulse generator that can generate a full-jetting driving pulse for each of the plurality of nozzle rows, based on the jetting-amount-adjusting mode and the common jetting-driving signal, and a full-jetting main controller that can cause each of the plurality of pressure-changing units to operate, based on the full-jetting driving pulse, wherein the full-jetting driving pulses are used to fully cover an image unit of a recording medium with the liquid jetted from the nozzle, and wherein respective full-jetting driving pulses are different according to respective jetting-amount-adjusting modes.

27. A liquid jetting apparatus according to claim 25, wherein:

the common jetting-driving signal is a periodical signal including a plurality of same pulse-waves within a period thereof, and the driving-pulse generator is adapted to generate a rectangular-pulse row corresponding to the period of the common jetting-driving signal based on the jetting-amount-adjusting mode, and generate an AND signal of the rectangular-pulse row and the common jetting-driving signal as the full-jetting driving pulse.

28. A liquid jetting apparatus according to claim 25, wherein:

the jetting-amount-adjusting mode can be a first adjusting mode for a nozzle from which a larger amount of the liquid tends to be jetted, or a second adjusting mode for a nozzle from which a smaller amount of the liquid tends to be jetted, the common jetting-driving signal is a periodical signal including n same pulse-waves within a period thereof, and the driving-pulse generator is adapted to generate, based on the common jetting-driving signal, a full-jetting driving-pulse including only p pulse-waves when the jetting-amount-adjusting mode is the first adjusting mode, p being one or more, and a full-jetting driving-pulse including only q pulse-waves when the jetting-amount-adjusting mode is the second adjusting mode, q being more than p and not more than n.

29. A liquid jetting apparatus according to claim 25, wherein:

the jetting-amount-adjusting mode can be a first adjusting mode for a nozzle from which a larger amount of the liquid tends to be jetted, or a second adjusting mode for a nozzle from which an intermediate amount of the liquid tends to be jetted, or a third adjusting mode for a nozzle from which a smaller amount of the liquid tends to be jetted, the common jetting-driving signal is a periodical signal including n same pulse-waves within a period thereof, and the driving-pulse generator is adapted to generate, based on the common jetting-driving signal, a full-jetting driving-pulse including only p pulse-waves when the jetting-amount-adjusting mode is the first adjusting mode, p being one or more, a full-jetting driving-pulse including only q pulse-waves when the jetting-amount-adjusting mode is the second adjusting mode, q being more than p, and a full-jetting driving-pulse including only r pulse-waves when the jetting-amount-adjusting mode is the third adjusting mode, r being more than q and not more than n.

30. A liquid jetting apparatus according to claim 28, wherein:

a weight of the liquid jetted from the nozzle based on the one pulse-wave is 3 to 5 ng.

31. A liquid jetting apparatus according to claim 25, wherein:

the pressure-changing unit has a piezoelectric vibrating member.

32. A liquid jetting apparatus according to claim 25, wherein:

the liquid is an ink.

33. A controlling unit for controlling a liquid jetting apparatus including a head member having a plurality of nozzles, and a plurality of pressure-changing units each of which can cause pressure of liquid in each of the plurality of nozzles to change in such a manner that the liquid is jetted from the nozzle, comprising a driving-signal generator that can generate a common jetting-driving signal, a mode storing unit that can store a jetting-amount-adjusting mode that has been set for each of the plurality of nozzles, a driving-pulse generator that can generate a full-jetting driving pulse for each of the plurality of nozzles, based on the jetting-amount-adjusting mode and the common jetting-driving signal, and a full-jetting main controller that can cause each of the plurality of pressure-changing units to operate, based on the full-jetting driving pulse, wherein the full-jetting driving pulses are used to fully cover an image unit of a recording medium with the liquid jetted from the nozzle, and wherein respective full-jetting driving pulses are different according to respective jetting-amount-adjusting modes.

34. A controlling unit for controlling a liquid jetting apparatus including a head member having a plurality of nozzles forming a plurality of nozzle rows, and a plurality of pressure-changing units each of which can cause pressure of liquid in each of the plurality of nozzles to change in such a manner that the liquid is jetted from the nozzle, comprising a driving-signal generator that can generate a common jetting-driving signal, a mode storing unit that can store a jetting-amount-adjusting mode that has been set for each of the plurality of nozzle rows, a driving-pulse generator that can generate a full-jetting driving pulse for each of the plurality of nozzle rows, based on the jetting-amount-adjusting mode and the common jetting-driving signal, and a full-jetting main controller that can cause each of the plurality of pressure-changing units to operate, based on the full-jetting driving pulse, wherein the full-jetting driving pulses are used to fully cover an image unit of a recording medium with the liquid jetted from the nozzle, and wherein respective full-jetting driving pulses are different according to respective jetting-amount-adjusting modes.

35. A controlling unit according to claim 33, wherein:

the common jetting-driving signal is a periodical signal including a plurality of same pulse-waves within a period thereof, and the driving-pulse generator is adapted to generate a rectangular-pulse row corresponding to the period of the common jetting-driving signal based on the jetting-amount-adjusting mode, and generate an AND signal of the rectangular-pulse row and the common jetting-driving signal as the full-jetting driving pulse.

36. A controlling unit according to claim 33, wherein:

the jetting-amount-adjusting mode can be a first adjusting mode for a nozzle from which a larger amount of the liquid tends to be jetted, or a second adjusting mode for a nozzle from which a smaller amount of the liquid tends to be jetted, the common jetting-driving signal is a periodical signal including n same pulse-waves within a period thereof, and the driving-pulse generator is adapted to generate, based on the common jetting-driving signal, a full-jetting driving-pulse including only p pulse-waves when the jetting-amount-adjusting mode is the first adjusting mode, p being one or more, and a full-jetting driving-pulse including only q pulse-waves when the jetting-amount-adjusting mode is the second adjusting mode, q being more than p and not more than n.

37. A controlling unit according to claim 33, wherein:

the jetting-amount-adjusting mode can be a first adjusting mode for a nozzle from which a larger amount of the liquid tends to be jetted, or a second adjusting mode for a nozzle from which an intermediate amount of the liquid tends to be jetted, or a third adjusting mode for a nozzle from which a smaller amount of the liquid tends to be jetted, the common jetting-driving signal is a periodical signal including n same pulse-waves within a period thereof, and the driving-pulse generator is adapted to generate, based on the common jetting-driving signal, a full-jetting driving-pulse including only p pulse-waves when the jetting-amount-adjusting mode is the first adjusting mode, p being one or more, a full-jetting driving-pulse including only q pulse-waves when the jetting-amount-adjusting mode is the second adjusting mode, q being more than p, and a full-jetting driving-pulse including only r pulse-waves when the jetting-amount-adjusting mode is the third adjusting mode, r being more than q and not more than n.

38. A controlling unit according to claim 36, wherein:

a weight of the liquid jetted from the nozzle based on the one pulse-wave is 3 to 5 ng.

* * * * *